US006363226B1

(12) United States Patent
Batori

(10) Patent No.: US 6,363,226 B1
(45) Date of Patent: Mar. 26, 2002

(54) ELECTROPHOTOGRAPHIC IMAGE FORMING APPARATUS

(75) Inventor: Yoshiyuki Batori, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/652,212

(22) Filed: Aug. 30, 2000

(30) Foreign Application Priority Data

Sep. 2, 1999 (JP) ..... 11-248867

(51) Int. Cl.[7] ..... G03G 15/00
(52) U.S. Cl. ..... 399/8; 399/12
(58) Field of Search ..... 399/12, 25, 8, 399/24, 79; 340/286.02; 709/212, 216, 217, 218

(56) References Cited

U.S. PATENT DOCUMENTS

| | | | | |
|---|---|---|---|---|
| 4,961,088 A | * | 10/1990 | Gilliland et al. | 399/25 |
| 5,398,257 A | * | 3/1995 | Groenteman | 375/200 |
| 5,491,540 A | * | 2/1996 | Hirst | 399/12 |
| 5,708,909 A | * | 1/1998 | Yamashita et al. | 399/8 |
| 5,911,096 A | | 6/1999 | Batori et al. | 399/111 |
| 5,920,753 A | | 7/1999 | Sasaki et al. | 399/111 |
| 5,930,553 A | * | 7/1999 | Hirst et al. | 399/8 |
| 5,930,562 A | | 7/1999 | Noda et al. | 399/114 |
| 5,937,237 A | | 8/1999 | Nonaka et al. | 399/106 |
| 5,940,658 A | | 8/1999 | Yokoi et al. | 399/119 |
| 5,999,708 A | * | 12/1999 | Kajita | 395/114 |
| 6,075,957 A | | 6/2000 | Batori et al. | 399/114 |
| 6,101,348 A | | 8/2000 | Nonaka et al. | 399/103 |
| 6,131,007 A | | 10/2000 | Yamaguchi et al. | 399/256 |
| 6,205,298 B1 | * | 3/2001 | Yamamoto | 399/25 |

FOREIGN PATENT DOCUMENTS

JP 8-171329 7/1996

* cited by examiner

*Primary Examiner*—Robert Beatty
(74) *Attorney, Agent, or Firm*—Fitzpatrick, Cella, Harper & Scinto

(57) ABSTRACT

An electrophotographic image forming apparatus to which a process cartridge is detachably mountable for forming an image onto a recording medium includes a recognizing device for recognizing identifying information peculiar to the process cartridge, a detector for detecting use status information when the process cartridge is used in the image forming apparatus, a rewritable memory for storing the identifying information recognized by the recognizing device and the use status information of the process cartridge detected by the detector, and an information communicating device for giving and receiving the use status information of the process cartridge stored in another electrophotographic image forming apparatus to which the process cartridge is detachably mountable to and from another electrophotographic image forming apparatus.

28 Claims, 12 Drawing Sheets

| FIG. 2A | FIG. 2B |
|---|---|

| FIG. 6A | FIG. 6B |
|---|---|

| FIG. 9A | FIG. 9B |
|---|---|

ELECTROPHOTOGRAPHIC IMAGE FORMING APPARATUS

BACKGROUND OF THE INVENTION

1. Field of the Invention

The present invention relates to an electrophotographic image forming apparatus to which a process cartridge is detachably mountable.

Here, an electrophotographic image forming apparatus is an apparatus which forms an image on a recording medium using an electrophotographic image forming method. Examples of electrophotographic image forming apparatus include an electrophotographic copying machine, an electrophotographic printer (such as an LED printer or a laser beam printer), an electrophotographic facsimile machine, and an electrophotographic word processor.

A process cartridge makes charging means, developing means, or cleaning means and an electrophotographic photosensitive member integrally into a cartridge which is detachably mountable to a main body of an image forming apparatus. Or, a process cartridge makes at least one of charging means, developing means, and cleaning means and an electrophotographic photosensitive member integrally into a cartridge which is detachably mountable to a main body of an image forming apparatus. Alternatively, a process cartridge makes at least developing means and an electrophotographic photosensitive member integrally into a cartridge which is detachably mountable to a main body of an image forming apparatus.

2. Related Background Art

Conventionally, in an electrophotographic image forming apparatus using an electrophotographic image forming process, a process cartridge method is adopted where an electrophotographic photosensitive member and process means acting on the electrophotographic photosensitive member are made integrally into a cartridge which is detachably mountable to the main body of the image forming apparatus. According to the process-cartridge method, the apparatus can be maintained by a user himself without requiring a serviceman, which greatly improves the operability of the apparatus. Therefore, the process cartridge method is widely used in image forming apparatus.

Such a process cartridge has toner remaining amount detecting means for detecting the remaining amount of toner (developer) in the cartridge such that, in a case where the cartridge runs out of toner, the out-of-toner state is indicated by indicating means of the image-forming-apparatus main body to invite change of the process cartridge and, at the same time, to stop the image forming operation.

Because of the recent trend toward larger toner capacity process cartridges, in order to detect the life of the process cartridge, not only detection by the toner remaining amount detecting means but also means for detecting the life of the electrophotographic photosensitive member and the life of sliding parts, for example, life detecting means for detecting the rotation number of a photosensitive drum or for counting the print sheet number or the print dots is used.

The process cartridge is detachably mountable to the main body of the image forming apparatus. Therefore, in a case where the process cartridge is changed during usage, for example, in a case after a cartridge for black color is used, a cartridge for red color is mounted and used, and then the cartridge for black color is again mounted and used, it is necessary to accurately detect and manage the life of the individual process cartridges.

Accordingly, Japanese Patent Application Laid-open No. 8-171329 proposes provision on a process cartridge of a bar code describing individual identifying information of the process cartridge such that the image forming apparatus main body reads the bar code to manage the life of the process cartridge.

The invention disclosed in Japanese Patent Application Laid-open No. 8-171329 is very effective.

The present invention represents further progress in the above-described related art.

SUMMARY OF THE INVENTION

An object of the present invention is to provide an electrophotographic image forming apparatus which can share the use status information of an identical process cartridge when the process cartridge is used in a plurality of electrophotographic image forming apparatus.

Another object of the present invention is to provide an electrophotographic image forming apparatus comprising recognizing means for recognizing identifying information peculiar to a process cartridge, detecting means for detecting use status information when the process cartridge is used for the image forming apparatus, rewritable storing means for storing the identifying information recognized by the recognizing means and the use status information of the process cartridge detected by the detecting means, and information communicating means for communicating the use status information of the process cartridge stored in another electrophotographic image forming apparatus to which the process cartridge is detachably mountable with the another electrophotographic image forming apparatus.

Still another object of the present invention is to provide an electrophotographic image forming apparatus comprising recognizing means for recognizing identifying information peculiar to a process cartridge, detecting means for detecting use status information when the process cartridge is used for the image forming apparatus, input means for inputting use status information when the process cartridge is used for another electrophotographic image forming apparatus to which the process cartridge is detachably mountable, rewritable storing means for storing the identifying information recognized by the recognizing means and the use status information detected by the detecting means or the use status information inputted by the input means, and information communicating means for communicating the use status information of the process cartridge stored in another electrophotographic image forming apparatus with another electrophotographic image forming apparatus.

Yet another object of the present invention is to provide an electrophotographic image forming apparatus comprising recognizing means for recognizing identifying information specific to a process cartridge, detecting means for detecting use status information when the process cartridge is used for the image forming apparatus, input means for inputting use status information when the process cartridge is used for other electrophotographic image forming apparatus to which the process cartridge is detachably mountable, and rewritable storing means for storing the identifying information recognized by the recognizing means, the use status information detected by the detecting means or the use status information inputted by the input means.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Embodiments of the present invention are now described in detail with reference to the drawings. The description is provided with regard to a laser beam printer as an embodiment of an electrophotographic image forming apparatus.

(First Embodiment)

Figure 1:
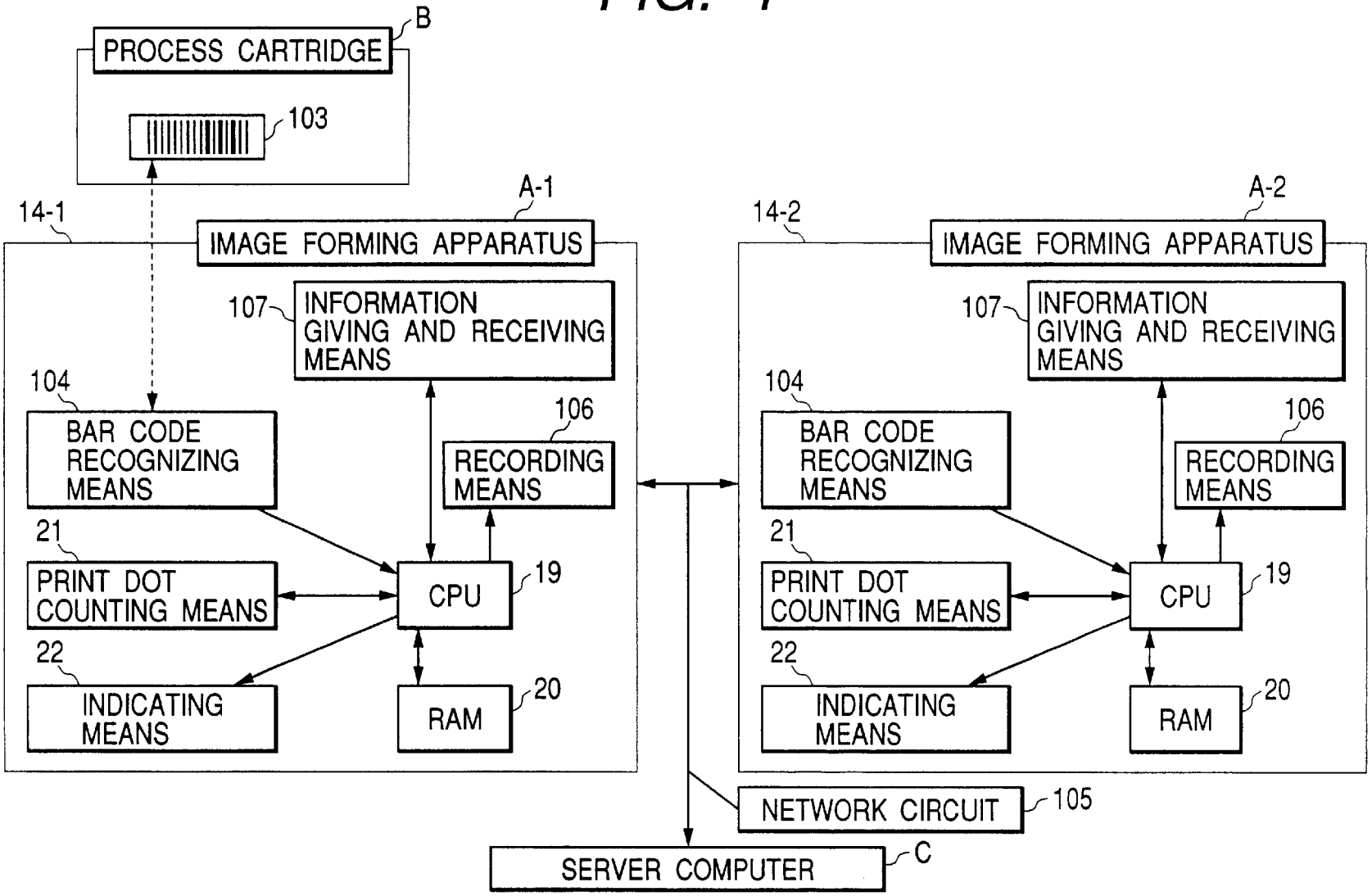
FIG. 1 is an explanatory view of the constitution of recognizing an identification of a process cartridge, the constitution of managing its life, and the constitution of communicating its use status information in an electrophotographic image forming apparatus according to a first embodiment of the present invention.
Figures 2, 2A:
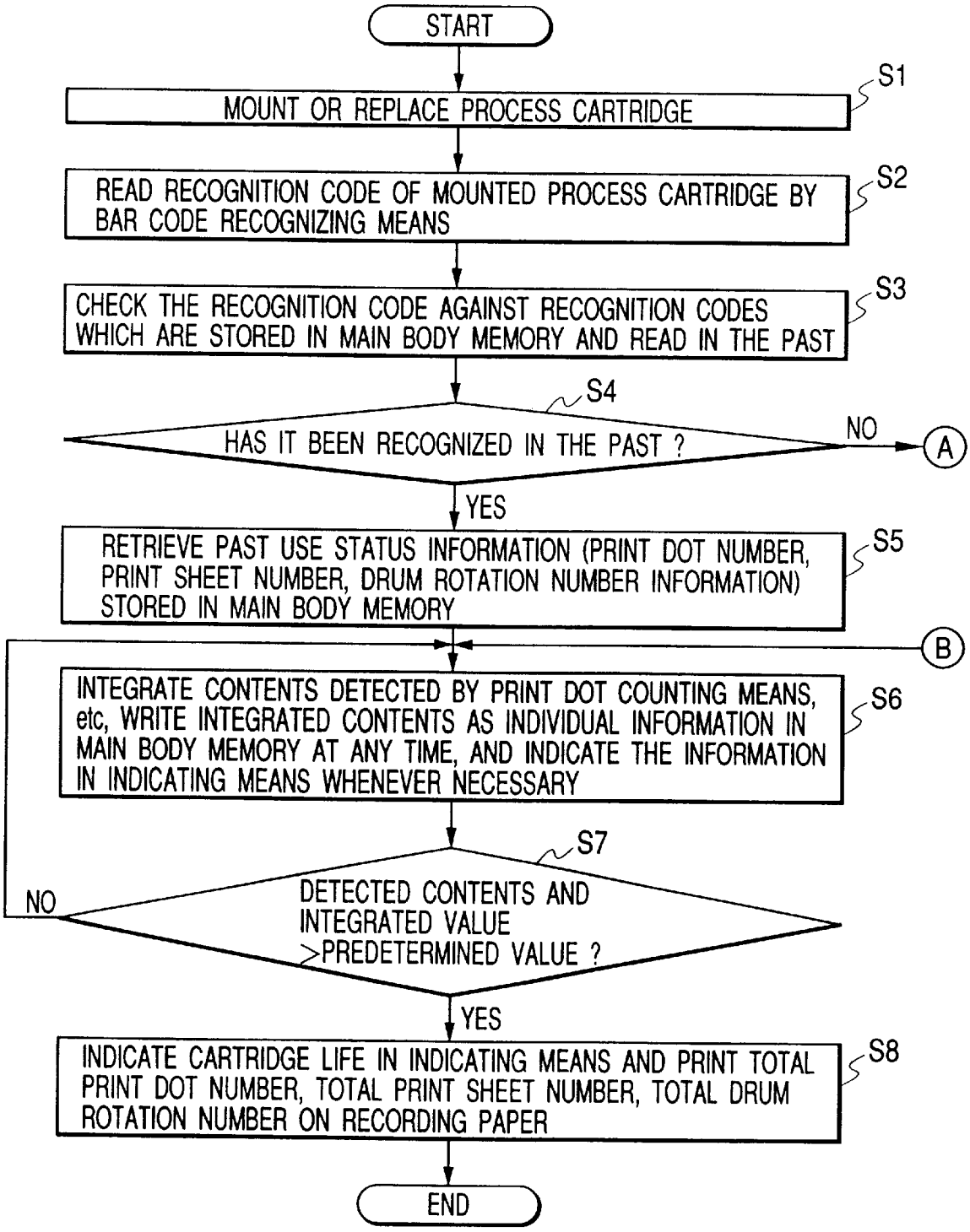
FIG. 2, which is comprised of FIGS. 2A and 2B, is a flowchart illustrating the procedure in the method of recognizing and identifying a process cartridge, detecting its life, and communicating its use status information in the electrophotographic image forming apparatus according to the first embodiment of the present invention.
Figure 2B:
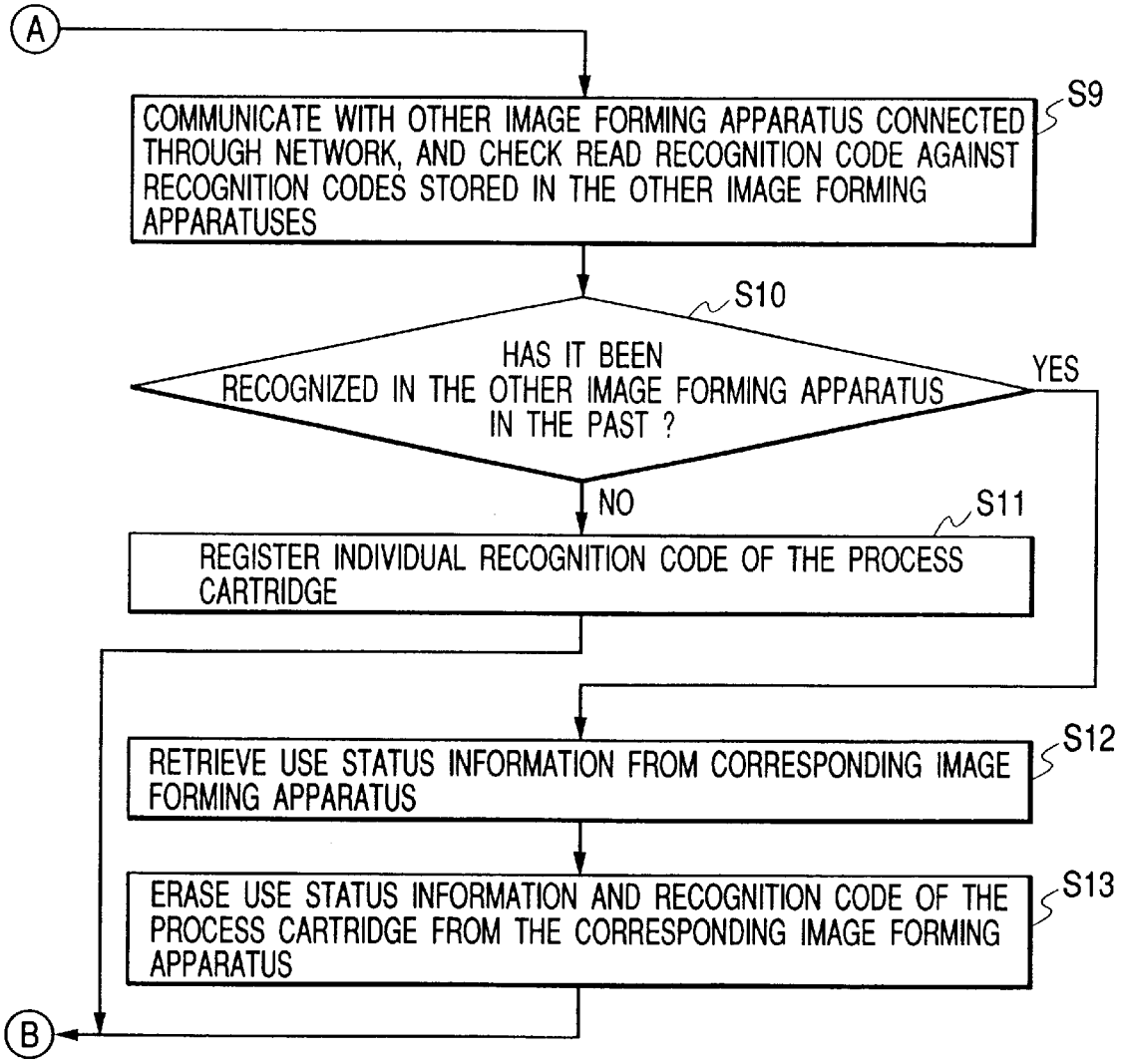
Figure 4:
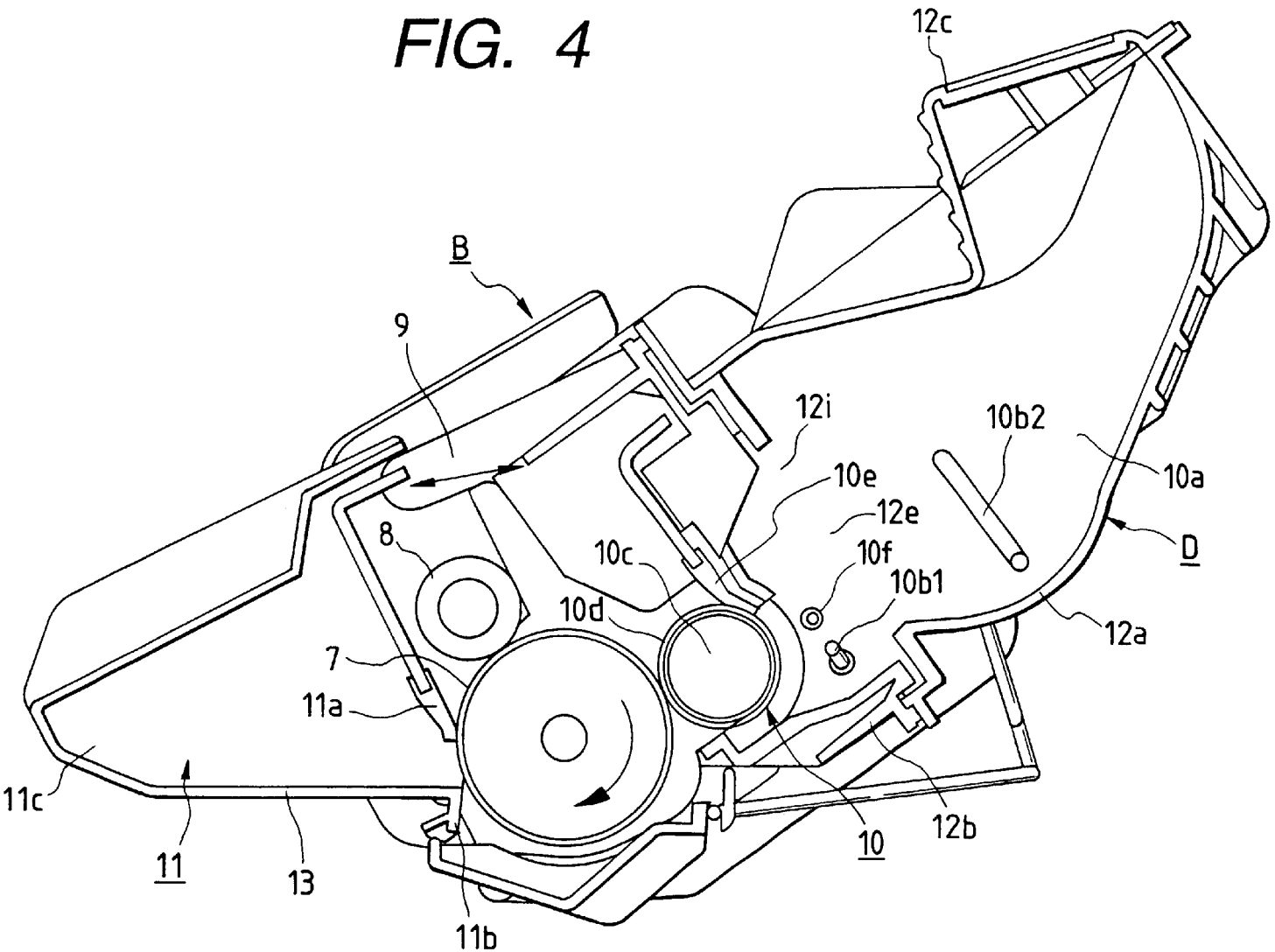
FIG. 4 is a vertical sectional view illustrating the structure of the process cartridge.
Figure 5:
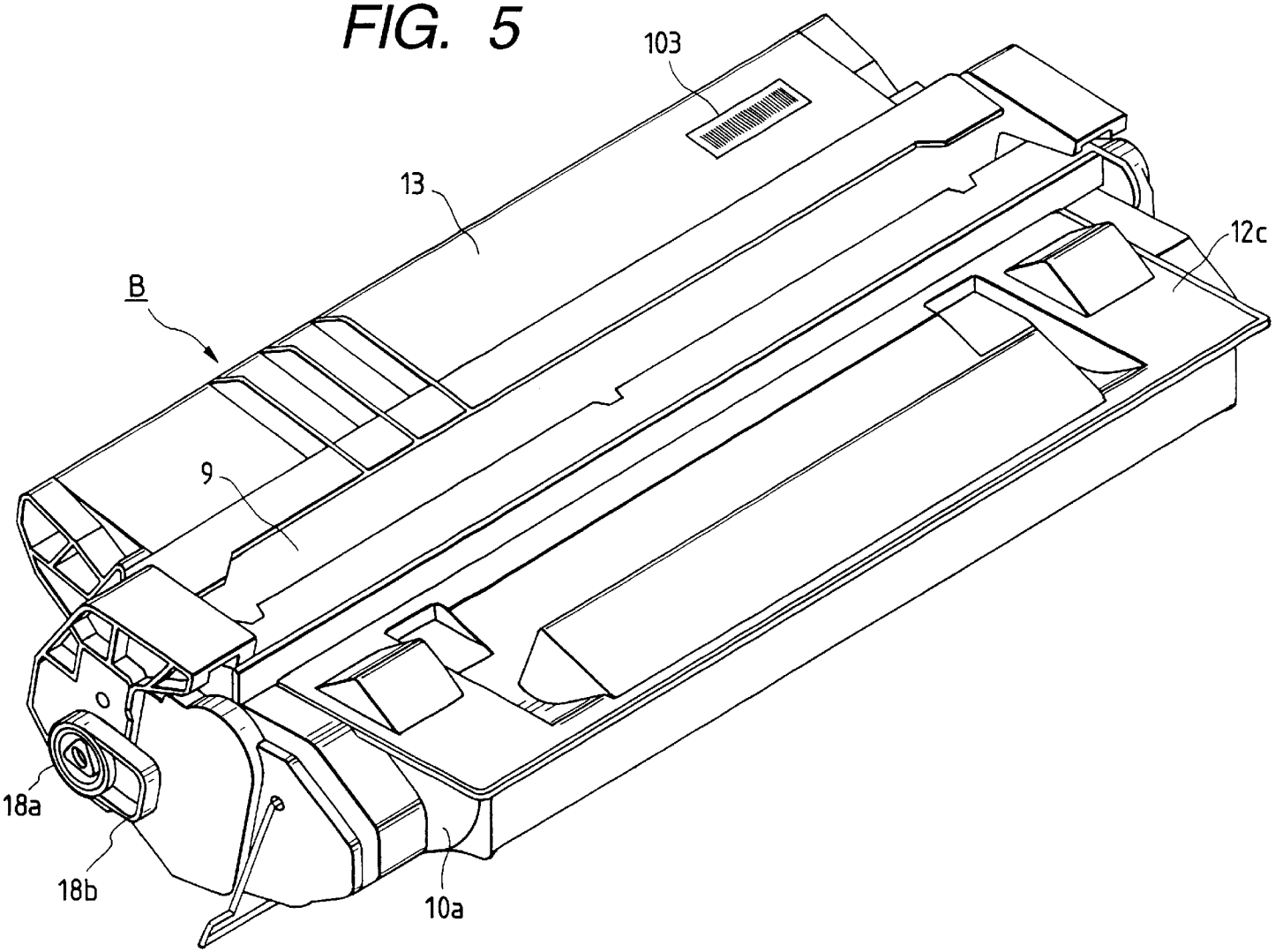
FIG. 5 is an explanatory view of the outward appearance of the process cartridge.

An electrophotographic image forming apparatus according to a first embodiment is specifically described with reference to FIGS. 1 to 5. It is to be noted that FIG. 1 is an explanatory view of the constitution of recognizing and identifying a process cartridge, the constitution of managing its life, and the constitution of communicating its use status information in the electrophotographic image forming apparatus, FIGS. 2A and 2B are flowcharts illustrating the procedure in the method of recognizing and identifying a process cartridge, detecting its life, and communicating its use status information, FIG. 3 is an explanatory view of the constitution of the electrophotographic image forming apparatus with a process cartridge mounted thereto, FIG. 4 is a vertical sectional view illustrating the structure of the process cartridge, and FIG. 5 is an explanatory view of the outward appearance of the process cartridge.

Here, first, the overall constitutions of the process cartridge and the electrophotographic image forming apparatus used with the process cartridge mounted thereto are described with reference to FIGS. 3 to 5. Then, the constitution of recognizing and identifying a process cartridge, the constitution of managing its life, and the constitution of communicating its use status information are described with reference to FIGS. 1, 2A, 2B and 5.

(Overall Constitution)

Figure 3:
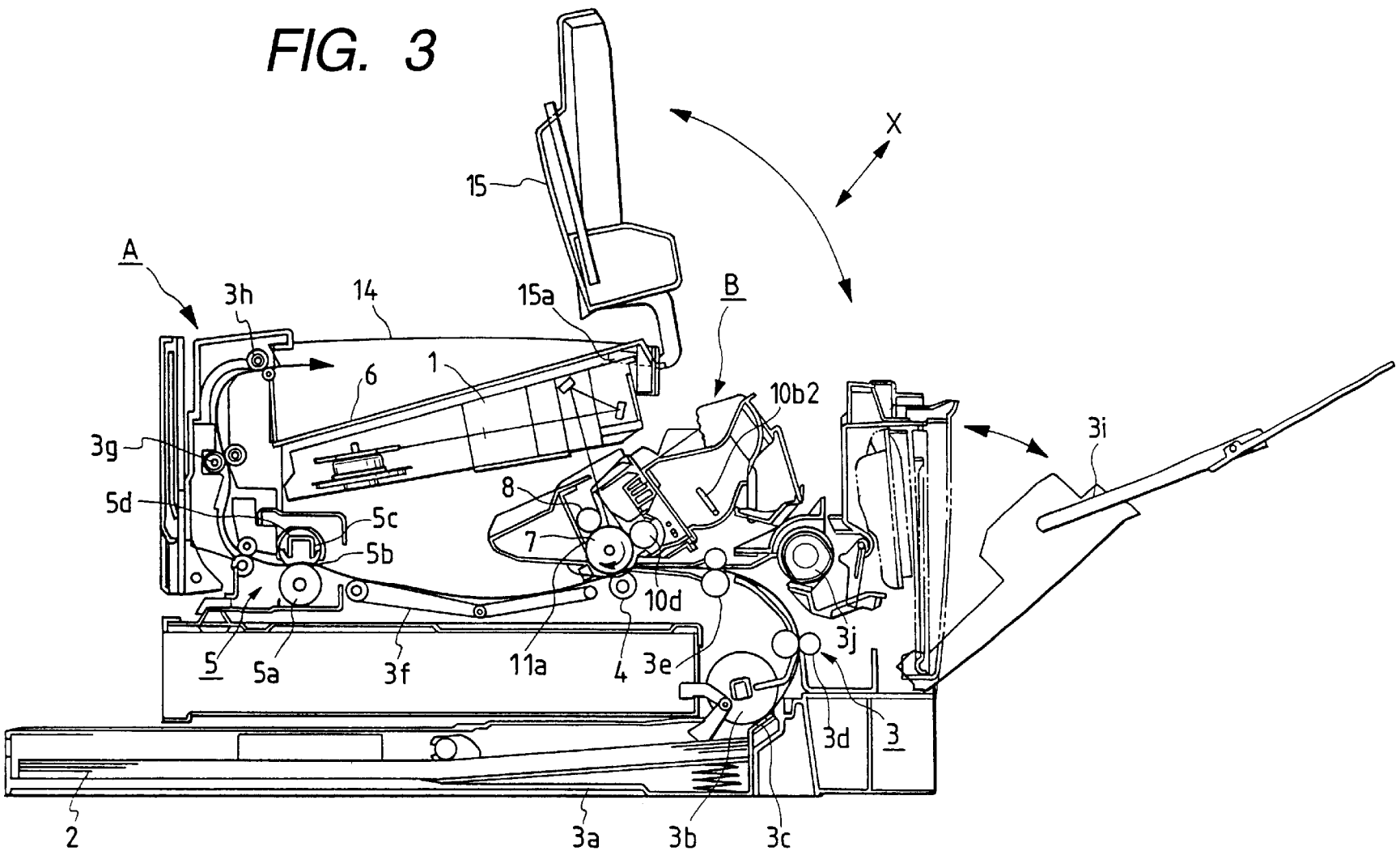
FIG. 3 is an explanatory view of the constitution of the electrophotographic image forming apparatus with a process cartridge mounted thereto.

As illustrated in FIG. 3, in an electrophotographic image forming apparatus (a laser beam printer) A of the present embodiment, information light based on image information, from an optical system 1 irradiates a drum-shaped electrophotographic photosensitive member (hereinafter referred to as a "photosensitive drum") 7 to form a latent image on the photosensitive drum 7. The latent image is developed with developer (hereinafter referred to as "toner") to form a toner image. In synchronism with the formation of the toner image, a recording medium (such as recording paper, an OHP sheet, or cloth) 2 is separated and fed from a cassette 3*a* containing recording media with a pickup roller 3*b* and a pressure-contact member 3*c* pressed against the pickup roller 3*b*, and is conveyed by conveying means 3 including a pair of conveying rollers 3*d*, a pair of registration rollers 3*e*, and the like. The toner image formed on the photosensitive drum 7 made into a cartridge as a process cartridge is transferred to the recording medium 2 by applying voltage to a transfer roller 4 as transfer means. The recording medium 2 is then conveyed to fixing means 5 by a conveying belt 3*f*. The fixing means 5 includes a driving roller 5*a* and a fixing rotary member 5*d* which has a built-in heater 5*b* and is made of a cylindrical sheet rotatably supported by a support 5*c*. The fixing means 5 applies heat and pressure to the recording medium 2 passing therethrough to fix the transferred toner image. The recording medium 2 is then conveyed by pairs of discharge rollers 3*g* and 3*h* to be discharged through a surface reverse conveying path to a discharge portion 6. It is to be noted that this image forming apparatus A can perform manual feed by utilizing a manual feed tray 3*i* and a roller 3*j*.

(Process Cartridge)

A process cartridge B is provided with an electrophotographic photosensitive member and at least one process means. Here, process means includes charging means for charging the electrophotographic photosensitive member, developing means for developing an electrostatic latent image formed on the electrophotographic photosensitive member, and cleaning means for cleaning out toner remaining on the surface of the electrophotographic photosensitive member. As illustrated in FIG. 4, in the process cartridge B of the present embodiment, the photosensitive drum 7 as the electrophotographic photosensitive member having a photosensitive layer is rotated, and voltage is applied to a charging roller 8 as the charging means to uniformly charge the surface of the photosensitive drum 7. The charged photosensitive drum 7 is exposed to a light image from the optical system 1 through an exposure opening 9 to form a electrostatic latent image. The electrostatic latent image is developed with developing means 10.

The developing means 10 feeds toner in a toner containing portion 10*a* into a developing frame 12*b* through an opening 12*i* of a toner frame 12*a* and an opening 12*e* of the developing frame 12*b* by a rotatable toner feeding member 10*b*2 as toner feeding means. The toner is agitated by a toner agitating member 10b1, a developing roller 10d as a developing rotary member having a stationary magnet 10c built therein is rotated, and a toner layer with triboelectrification charge applied thereto is formed by a developing blade 10e on the surface of the developing roller 10d. By transferring the toner onto the photosensitive drum 7 so as to correspond to the electrostatic latent image, a toner image is formed as a visualized image.

Then, voltage having the opposite polarity to that of the toner image is applied to the transfer roller 4 to transfer the toner image onto the recording medium 2. After that, toner remaining on the photosensitive drum 7 is scraped off by a cleaning blade 11a, dipped up by a dip sheet 11b, and is collected by cleaning means 11 in a removed toner containing portion 11c. In this way, the toner remaining on the photosensitive drum 7 is removed.

Further, an antenna bar 10f is provided as developer remaining amount detecting means for detecting the remaining amount of the toner (the remaining amount of the developer) at a position spaced by a predetermined distance from the developing roller 10d. The capacitance between the antenna bar 10f and the developing roller 10d changes depending on the amount of the toner existing between the two. By detecting the change in the capacitance as change in the electric potential difference, the remaining amount of the toner is detected.

It is to be noted that the respective members such as the photosensitive drum 7, the charging roller 8, and the developing means 10 are housed in a cartridge frame and made into a cartridge, which is detachably mountable to cartridge mounting means provided in a main body 14 of the electrophotographic image forming apparatus. The cartridge frame is formed by coupling a developing unit D and a cleaning frame 13. The developing unit D is integrally formed by welding the toner frame 12a forming the toner containing portion 10a and supporting the toner feeding member 10b2 so as to be rotatably driven, the developing frame 12b having developing members built therein such as the toner agitating member 10b1 the developing roller 10d, and the developing blade 10e, and a lid member 12c. The cleaning frame 13 forms the removed toner containing portion 11c and has the photosensitive drum 7, the cleaning blade 11a, the dip sheet 11b, and the charging roller 8.

As illustrated in FIG. 3, in the cartridge mounting means, when an openable and closable member 15 is opened about a shaft 15a, space for a cartridge mounting portion appears with cartridge mounting guide members (not shown) disposed on both sides thereof. Guide members of the process cartridge B each formed of a boss 18a and a rib 18b (see FIG. 5) are engaged with and guided by the mounting guide members, respectively, to make it possible to mount and dismount the process cartridge B in directions shown by the double-headed arrow X (see FIG. 3) to and from the main body 14 of the electrophotographic image forming apparatus A.

(Constitution of Recognizing Identification of Process Cartridge and Constitution of Managing Its Life)

The constitution of recognizing an identification of a process cartridge, the constitution of managing its life, and the method of communicating its use status information by the electrophotographic image forming apparatus according to the present embodiment are now described with reference to FIGS. 1, 2A, 2B and 5.

First, the constitution of means for recognizing the identification of the process cartridge B is described with reference to FIG. 5. A bar code 103 as individual identifying means is provided on a predetermined position on the process cartridge B. A peculiar recognition code which is individual identifying information (an individual identification number) for recognizing and identifying the process cartridge B is recorded in the bar code 103. The process cartridge B is used by being mounted to the electrophotographic image forming apparatus main bodies 14 of the plurality of electrophotographic image forming apparatus A. It is to be noted that, in the present embodiment, in order to discriminate the plurality of electrophotographic image forming apparatus A using the identical process cartridge B, these electrophotographic image forming apparatus are denoted as A-1, A-2, A-3 (not shown), . . . , while the electrophotographic image forming apparatus main bodies of the respective electrophotographic image forming apparatus A-1, A-2, A-3 (not shown), . . . are denoted as 14-1, 14-2, 14-3 (not shown), . . . , respectively.

As shown in FIG. 1, (each of) the electrophotographic image forming apparatus (hereinafter referred to as "image forming apparatus") A-1, A-2, A-3, . . . has in its electrophotographic image forming apparatus main body (hereinafter referred to as "image forming apparatus main body") 14-1, 14-2, 14-3, . . . a CPU 19 as controlling means, a RAM (hereinafter referred to as "a main body memory") 20 as storing means, a print dot counting means 21 as detecting means, indicating means 22, bar code recognizing means 104 as recognizing means, recording means 106, and information giving and receiving means 107 such as a modem. The image forming apparatus A-1, A-2, A-3, . . . are connected in parallel through a network circuit 105 as correspondence means connected to their respective information giving and receiving means 107.

The CPU 19 is a central processing unit for reading a stored program or various kinds of data, carrying out the necessary calculation or judgement, and carrying out various kinds of control. The bar code recognizing means 104 reads the information (recognition code) on the bar code 103 when the process cartridge B is mounted to the image forming apparatus main body 14-1 or 14-2, and based on the information read by the bar code recognizing means 104, the CPU 19 identifies the process cartridge B. More specifically, the CPU 19 checks the recognition code on the process cartridge B read by the bar code recognizing means 104 against recognition codes stored in the main body memory 20, and by this the individual identification numbers of the process cartridges B are managed.

Further, the CPU 19 inputs a signal representing the number of print dots which is the use status information of the process cartridge B detected by the print dot counting means 21, and based on the number of print dots of the mounted process cartridge B, detects to what extent the process cartridge B has been used.

Further, the CPU 19 operates the recording means 106 such that the use past record information of the process cartridge B is printed onto a recording sheet of paper provided in the recording means 106.

Still, further, the CPU 19 indicates the result of the detection on the indicating means 22 such that a user is informed of the use status or the like of the process cartridge B.

The CPU 19 also operates the information giving and receiving means 107 such that the signal representing the number of print dots which is the use status information of the process cartridge B detected by the print dot counting means 21 and various kinds of control signals for controlling the CPU 19 of other image forming apparatus are given and received between this image forming apparatus and the other image forming apparatus through the network circuit 105.

It is to be noted that, although in the present embodiment, the number of print dots counted by the print dot counting means 21 is used as the use status information of the process cartridge B, the present invention is not limited thereto. The number of the print sheets of the recording media 2 (the number of the outputted sheets after image formation (printing)) counted by a print sheet number counting means (not shown), the number of drum rotations of the photosensitive drum 7 or the time period during which the photosensitive drum 7 has been used that is counted by a drum rotation number/use time counting means (not shown), or the like may also be used as the use status information of the process cartridge B.

Next, recognizing an identification of a process cartridge, managing its life, and communicating its use status information in the electrophotographic image forming apparatus according to the present embodiment is described according to the procedure illustrated in the flowcharts of FIGS. 2A and 2B.

When the process cartridge B is mounted to the image forming apparatus main body 14-1 of the image forming apparatus A-1, or when the process cartridge B replaces a process cartridge B already mounted to the image forming apparatus main body 14-1 (S1), the recognition code of the bar code 103 provided on the process cartridge B is read by the bar code recognizing means 104 of the image forming apparatus main body 14-1 (S2).

The timing of the reading of the recognition code may be arbitrary. For example, the recognition code may be read at the time of initial rotation of the photosensitive drum 7 (a period during which a main motor is reactivated by inputting an image formation start signal to rotatively drive again the photosensitive drum 7 thereby making the image forming apparatus A-1 carry out a predetermined operation prior to image formation for some time), or when the openable and closable member 15 is opened or closed for the purpose of changing the process cartridge.

After the recognition code is read, the CPU 19 checks the recognition code read this time against recognition codes stored in the main body memory 20 that were read in the past (S3).

As a result of the check (S4), if the recognition code read this time has been recognized in the past (YES), it is judged that the process cartridge B is remounted, and the procedure proceeds to step S5. If the recognition code read this time has not been recognized (NO), it is judged that the process cartridge B is used for the first time in the image forming apparatus A-1 (a new process cartridge or a process cartridge which has been used in another image forming apparatus A-2), and the procedure proceeds to step S9.

Here, first, on the assumption that the process cartridge B is remounted, the procedure proceeds to step S5.

At step S5, past use status information (print dot number, print sheet number, drum rotation number/use time information or the like) corresponding to the recognition code of the process cartridge B stored in the main body memory 20 is retrieved, and the procedure proceeds to step S6. At step S6, the use status information (print dot number, print sheet number, drum rotation number/use time information or the like) of the process cartridge B detected by the print dot counting means 21, the print sheet number counting means (not shown), the drum rotation number/use time counting means (not shown) or the like is integrated with the past use status information by the CPU 19, and the integrated use status information is rewritten and stored at any time as the use status information peculiar to the process cartridge B in the main body memory 20. Further, whenever necessary, the integrated use status information is indicated using the indicating means 22. The timing of the rewriting of the main body memory 20 may be set arbitrarily, such as every time after image recording onto the recording medium 2 ends, or at the time of post-rotation of the photosensitive drum 7 (a time period after image recording ends during which the photosensitive drum 7 is rotatively driven, thereby making the image forming apparatus A-1 carry out a predetermined post-operation for some time).

Then, it is determined whether the integrated use status information of the process cartridge B (for example, the integrated print dot number) exceeds a predetermined value or not (S7). The predetermined value is the value of a print dot number, a print sheet number, or a drum rotation number/use time which is immediately before satisfactory image formation becomes impossible due to toner depletion as a result of using the process cartridge B. The value is written in the main body memory 20.

If the integrated print dot number does not exceed the predetermined value, the life of the process cartridge B has not yet been lost, and thus, the image formation can be continued. On the other hand, if the integrated print dot number exceeds the predetermined value, since the life of the process cartridge B has been lost, the indicating means 22 indicates that fact and invites the user to exchange the process cartridge B, and use past record information such as the total print dot number, the total print sheet number, or the total drum rotation number/use time is printed by the recording means 106 onto a recording sheet of paper (SB).

A case where the check at step S4 reveals that the recognition code read this time has not been recognized in the past is now described.

If the recognition code read this time has not been recognized in the past, there are two possibles: the process cartridge B is new; and the process cartridge has been used in other image forming apparatus A-2, A-3, . . . , but is used in the image forming apparatus A-1 for the first time.

At step S9, the image forming apparatus A-1 communicates with other image forming apparatus A-2, A-3, . . . connected through the network circuit 105 using the network circuit 105, and checks the recognition code read this time against recognition codes stored in the main body memories 20 of other image forming apparatus A-2, A-3, . . .

As a result of the check (S10), if the recognition code has not been recognized by other image forming apparatus A-2, A-3, . . . in the past (NO), the procedure proceeds to step S11. If the recognition code has been recognized (YES), the procedure proceeds to step S12.

If the recognition code has not been recognized, at step S11, the mounted process cartridge B is judged as new, and the recognition code of the process cartridge B is registered in the main body memory 20 of the image forming apparatus A-2. The procedure then proceeds to step S6.

At step S6, the use status information (print dot number, print sheet number, drum rotation number/use time information or the like) of the process cartridge B detected by the print dot counting means 21, the print sheet number counting means (not shown), and the drum rotation number/use time counting means (not shown) or the like is rewritten and stored by the CPU 19 in the main body memory 20 at any time as the use status information peculiar to the process cartridge B. Further, whenever necessary, the integrated use status information is indicated using the indicating means 22.

Then, the procedure proceeds to step S7, where it is judged whether the use status information (contents detected by the print dot counting means 21, the print sheet number counting means (not shown), the drum rotation number/use time counting means (not shown) or the like) exceeds the predetermined value or not. If the integrated print dot number does not exceed the predetermined value, the process cartridge B has not yet reached the end of its life, and thus, the image formation operation can be continued. On the other hand, if the integrated print dot number exceeds the predetermined value, since the life of the process cartridge B has been lost, the indicating means 22 indicates that fact and invites the user to exchange the process cartridge B, and use past record information such as the total print dot number, the total print sheet number, or the total drum rotation number/use time is printed by the recording means 106 onto a recording sheet of paper (S8).

If, at step S10, the recognition code has been recognized by other image forming apparatus A-2, A-3, . . . in the past, at step S12, use status information (print dot number, print sheet number, drum rotation number/use time information or the like) of the process cartridge B is retrieved from the main body memory 20 of the image forming apparatus A-2, A-3, . . . Then, the use status information and the recognition code with regard to the process cartridge B stored in the image forming apparatus A-2, A-3, . . . are erased (S13), and the procedure proceeds to step S6.

At step S6, the use status information (print dot number, print sheet number, drum rotation number/use time information or the like) retrieved from other image forming apparatus A-2, A-3, . . . is integrated by the CPU 19 with the use status information (print dot number, print sheet number, drum rotation number/use time information or the like) of the process cartridge B detected by the print dot counting means 21, the print sheet number counting means (not shown), and the drum rotation number/use time counting means (not shown) or the like, and the integrated use status information is rewritten and stored at any time as the use status information peculiar to the process cartridge B in the main body memory 20. Further, whenever necessary, the integrated use status information is indicated using the indicating means 22.

Then, the procedure proceeds to step S7, where it is judged whether the integrated use status information (for example, the integrated print dot number) exceeds the predetermined value or not. If the integrated print dot number does not exceed the predetermined value, the process cartridge B has not yet reached the end of its life, and thus, the image formation operation can be continued. On the other hand, if the integrated print dot number exceeds the predetermined value, since the life of the process cartridge B has been lost, the indicating means 22 indicates that fact and invites the user to exchange the process cartridge B, and use past record information such as the total print dot number, the total print sheet number, or the total drum rotation number/use time is printed by the recording means 106 onto a recording sheet of paper (S8).

In a case where the process cartridge B is used in image forming apparatus A-2, A-3, . . . other than the image forming apparatus A-1, the image forming apparatus A-1, A-2, A-3, . . . described in the present embodiment recognize the identification data of the process cartridge B, manage its life, and communicate its use status information according to a similar procedure.

In this way, each of the image forming apparatus A-1, A-2, A-3, . . . according to the present embodiment can communicate the use status information with regard to the process cartridge B stored in other image forming apparatus with other image forming apparatus based on the individual identifying information (recognition code) of the process cartridge B through the network circuit 105 using the information giving and receiving means 107. This makes it possible for the plurality of image forming apparatus A-1, A-2, A-3, . . . to share the use status information of the identical process cartridge when the process cartridge is used in the plurality of image forming apparatus A-1, A-2, A-3, . . .

Further, since the use past record information of the process cartridge B is recorded onto a recording sheet of paper by the recording means 106, the use past record information of the process cartridge B such as the total print dot number, the total print sheet number, or the total drum rotation number/use time is known when the process cartridge B is recycled, and a judgment about reused parts can be made easily. In addition, the use past record information can be fed back to aid in the designing of parts.

As described in the above, when the process cartridge B reaches the end of its life, the indicating means 22 indicates that fact and invites the user to exchange the process cartridge B, and the use past record information, such as the total print dot number, the total print sheet number, or the total drum rotation number/use time is printed by the recording means 106 onto a recording sheet of paper. After the process cartridge B is exchanged, the use past record information of the process cartridge B that reached the end of its life becomes unnecessary. Therefore, the user can erase only that particular use past record information, or the number of individual identifying information that can be stored is fixed in advance and, when the main body memory 20 is full, the CPU 19 erases the individual identifying information in the order from the oldest one.

In the present embodiment, an example where the use status information of the process cartridge B is stored in main body memories 20 provided in the image forming apparatus A-1, A-2, A-3, . . . which use the process cartridge B has been described. However, the use status information of the process cartridge B may be stored in storing means (not shown) of a server computer C connected through the network circuit 105 such that the use status information of each process cartridge is retrieved from the server computer C whenever necessary. Such constitution has the advantage that the use status of a plurality of process cartridges used in a plurality of image forming apparatus can be managed collectively in a centralized way.

Further, in the present embodiment, the use status information of a process cartridge is communicated between a plurality of image forming apparatus through the network circuit 105 connected to the information giving and receiving means 107. However, no problem arises even if the communication is through infrared radiation or electromagnetic waves. Such communication has an advantage that the network circuit 105 can be eliminated.

Still further, in the present embodiment, the plurality of image forming apparatus may be connected in parallel or may be connected serially through the network circuit 105.

(Second Embodiment)

The present embodiment is an example of an electrophotographic image forming apparatus which recognizes an identification of a process cartridge, manages its life, and communicates its use status information without using the correspondence means between a plurality of electrophotographic image forming apparatus.

(Constitution of Recognizing Identification of Process Cartridge and Constitution of Managing its Life)

Figures 6, 6A:
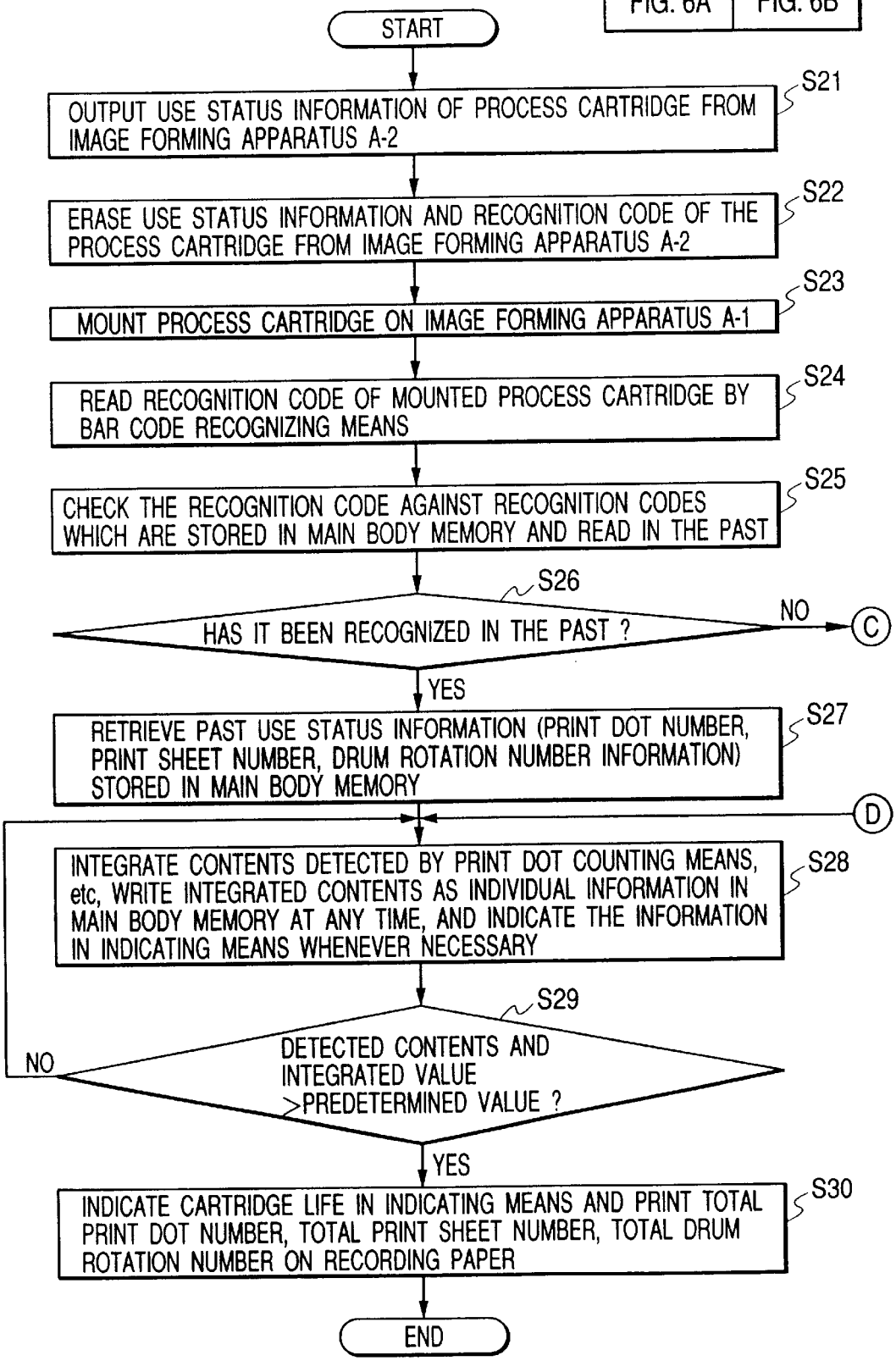
FIG. 6, which is comprised of FIGS. 6A and 6B, is a flowchart illustrating the procedure in the method of recognizing and identifying a process cartridge, detecting its life, and communicating its use status information in an electrophotographic image forming apparatus according to a second embodiment of the present invention.
Figure 6B:
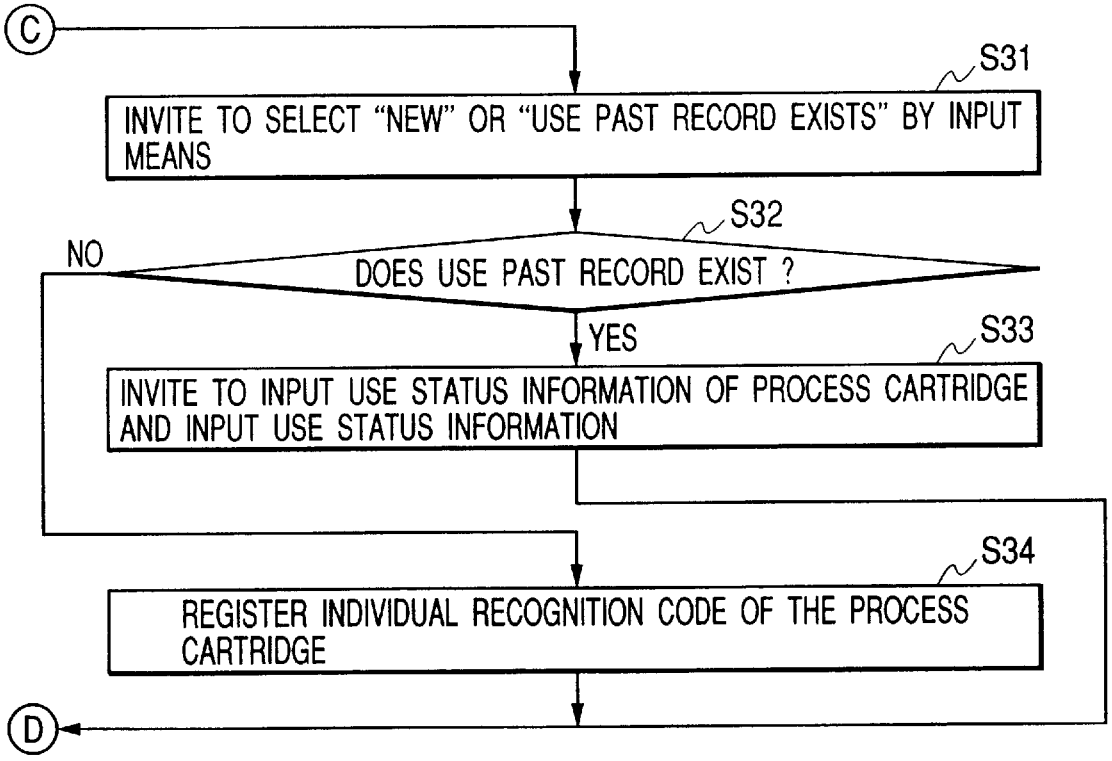

The constitution of recognizing an identification of a process cartridge, the constitution of managing its life, and the method of giving and receiving its use status information by the electrophotographic image forming apparatus according to the present embodiment are now described with reference to FIGS. 6A, 6B and 7. It is to be noted that FIGS. 6A and 6B are flowcharts illustrating the procedure in the method of recognizing an identification of a process cartridge, detecting its life, and giving and receiving its use status information, and FIG. 7 is an explanatory view of the constitution of recognizing an identification of a process cartridge, the constitution of managing its life, and the constitution of giving and receiving its use status information in the electrophotographic image forming apparatus.

Figure 7:
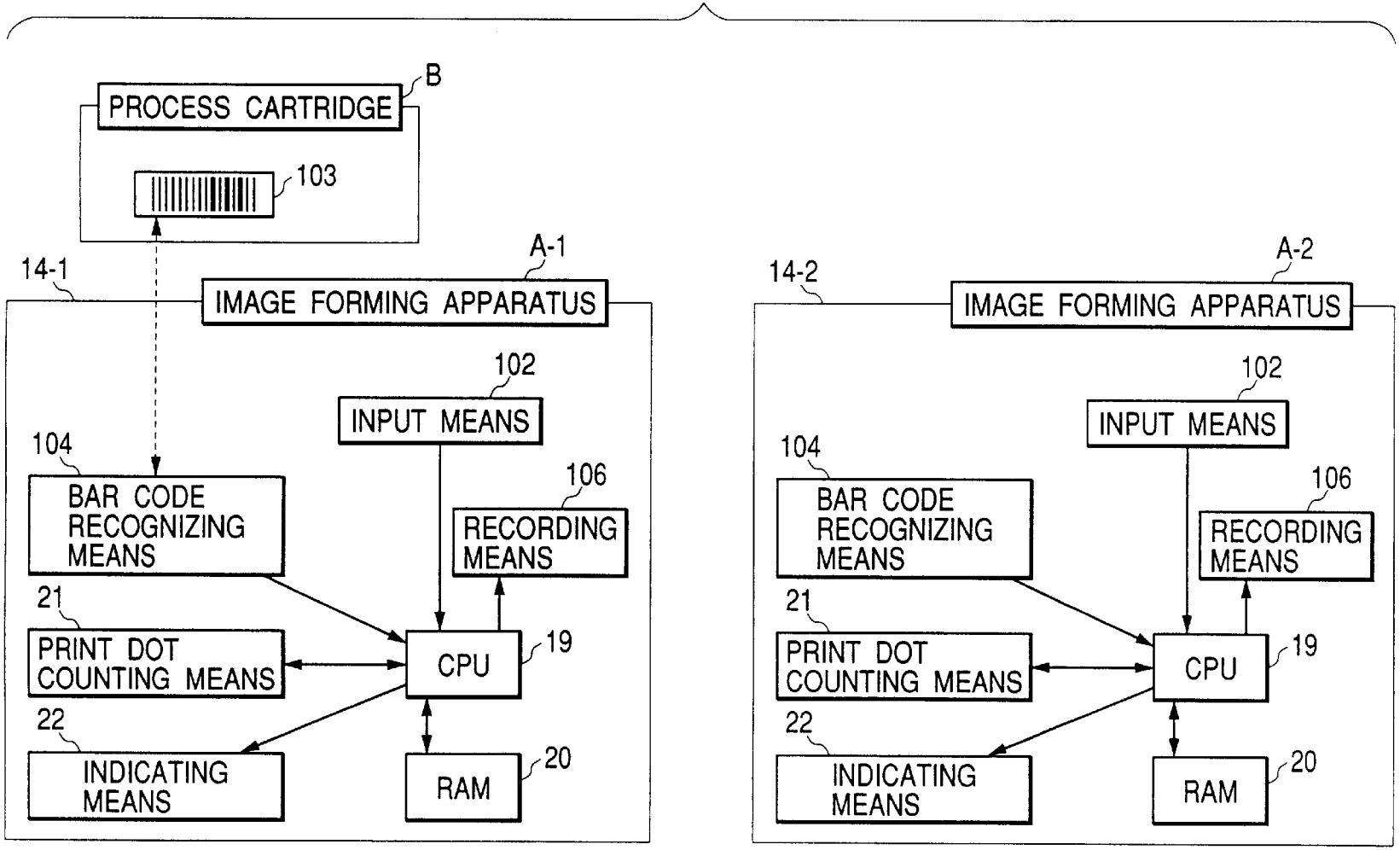
FIG. 7 is an explanatory view of the constitution of recognizing and identifying a process cartridge, the constitution of managing its life, and the constitution of communicating its use status information in the electrophotographic image forming apparatus according to the second embodiment of the present invention.

As shown in FIG. 7, each of the electrophotographic image forming apparatus A-1, A-2, A-3 (not shown), . . . has in its image forming apparatus main body 14-1, 14-2, 14-3 (not shown), . . . input means 102 for inputting the use status information of the process cartridge B instead of the information giving and receiving means 107 and the network circuit 105 used with regard to the above-described electrophotographic image forming apparatus of the first embodiment. It is to be noted that parts identical with or corresponding to those in the first embodiment are designated by identical reference characters and the description thereof is omitted.

Recognizing an identification of a process cartridge, detecting its life, and communicating its use status information in the electrophotographic image forming apparatus according to the present embodiment is now described below according to the procedure illustrated in the flowcharts of FIGS. 6A and 6B.

The present embodiment is described on the assumption that, in FIG. 7, the process cartridge B which has been used in the image forming apparatus A-2 is moved to and used in the image forming apparatus A-1.

With the process cartridge B mounted to the image forming apparatus main body 14-2 of the image forming apparatus A-2, the contents of the use status information (print dot number, print sheet number, drum rotation number/use time information or the like) of the process cartridge B stored in the main body memory 20 of the image forming apparatus A-2 is outputted by printing them onto a recording sheet of paper by the recording means 106 (S21).

After the use status information of the process cartridge B is outputted, the use status information and the recognition code of the process cartridge B are erased (S22).

The use status information is written in letters, numerals, symbols or the like such that a user can distinguish them.

When the process cartridge B is mounted to the image forming apparatus main body 14-1 of the image forming apparatus A-1 (S23), the recognition code on the bar code 103 provided on the process cartridge B is read by the bar code recognizing means 104 (S24).

The timing of reading the recognition code may be arbitrary. The recognition code may be read at the time of initial rotation of the photosensitive drum 7 (a period during which a main motor is reactivated by inputting an image formation start signal to rotatively drive again the photosensitive drum 7 thereby making the image forming apparatus A-1 carry out a predetermined operation prior to an image formation for some time), or, when the openable and closable member 15 is opened or closed for the purpose of exchanging the process cartridge.

After the recognition code is read, the CPU 19 checks the recognition code read this time against recognition codes stored in the main body memory 20 and read in the past (S25).

As a result of the check (S26), if the recognition code read this time has been recognized in the past (YES), it is judged that the process cartridge B is remounted, and the procedure proceeds to step S27. If the recognition code read this time has not been recognized (NO), it is judged that the process cartridge B is used for the first time in the image forming apparatus A-1 (a new process cartridge or a process cartridge which has been used in another image forming apparatus A-2), and the procedure proceeds to step S31.

Here, since the process cartridge B is moved from the image forming apparatus A-2 to the image forming apparatus A-1, the procedure proceeds to step S31.

The user is invited by the indicating means 22 of the image forming apparatus A-1 to select "new" or "use past record exists" using the input means 102 (S31). As a result of the selection (S32), if "use past record exists" (YES), the procedure proceeds to step S33. If "new" (NO), the procedure proceeds to step S34.

At step S33, the user is invited by the indicating means 22 to input use status information of the process cartridge B using the input means 102. The user inputs the use status information outputted at step S21 to the image forming apparatus A-1.

When the input operation by the user ends, the procedure proceeds to step S28.

At step S28, the use status information of the process cartridge B detected by the print dot counting means 21, the print sheet number counting means (not shown), the drum rotation number/use time counting means (not shown) or the like is integrated by the CPU 19 with the past use status information (print dot number, print sheet number, drum rotation number/use time information or the like) inputted to the image forming apparatus A-1, and the integrated use status information is rewritten and stored at any time as the use status information peculiar to the process cartridge B in the main body memory 20. Further, whenever necessary, the integrated use status information is indicated using the indicating means 22. The timing of rewriting the main body memory 20 may be set arbitrarily, for example, every time after image recording onto the recording medium 2 ends, or at the time of post-rotation of the photosensitive drum 7 (a period after an image recording ends during which the photosensitive drum 7 is rotatively driven thereby making the image forming apparatus A-1 carry out a predetermined post-operation for some time).

Then, it is determined whether the integrated use status information (for example, the integrated print dot number) of the process cartridge B exceeds a predetermined value or not (S29). The predetermined value is the value of a print dot number generated immediately before satisfactory image formation becomes impossible due to toner depletion as a result of using the process cartridge B. The value is written in the main body memory 20.

If the integrated print dot number does not exceed the predetermined value, the life of the process cartridge B has not yet ended, and thus image formation can be continued. On the other hand, if the integrated print dot number exceeds the predetermined value, since the life of the process cartridge B has ended, the indicating means 22 indicates that fact and invites the user to exchange the process cartridge B, and use past record information such as the total print dot number, the total print sheet number, or the total drum rotation number/use time is printed by the recording means 106 onto a recording sheet of paper (S30).

As a result of the selection at step S32, if "new", the procedure proceeds to step S34.

At step S34, the individual recognition code of the process cartridge B is newly registered in the main body memory 20.

As soon as the registration of the individual recognition code of the process cartridge B ends, the procedure proceeds to step S28.

At step S28, the use status information (print dot number, print sheet number, drum rotation number/use time information or the like) of the process cartridge B detected by the print dot counting means 21, the print sheet number counting means (not shown), the drum rotation number/use time counting means (not shown) or the like is rewritten and stored by the CPU 19 in the main body memory 20 at any time as the use status information peculiar to the process cartridge B. Further, whenever necessary, the integrated use status information is indicated using the indicating means 22.

Then, the procedure proceeds to step S29, where it is judged whether the use status information (contents detected by the print dot counting means 21, the print sheet number counting means (not shown), the drum rotation number/use time counting means (not shown) or the like) exceeds the predetermined value or not. If the integrated print dot number does not exceed the predetermined value, the life of the process cartridge B has not yet ended, and thus, the image formation can be continued. On the other hand, if the integrated print dot number exceeds the predetermined value, since the life of the process cartridge B has ended, the indicating means 22 indicates that fact and invites the user to exchange the process cartridge B, and use past record information such as the total print dot number, the total print sheet number, or the total drum rotation number/use time is printed by the recording means 106 onto a recording sheet of paper (S30).

If, at step S26, the recognition code has been recognized in the past, it is judged that the process cartridge B is remounted, and the procedure proceeds to step S27.

At step S27, use status information (print dot number, print sheet number, drum rotation number/use time information or the like) of the process cartridge B is retrieved from the main body memory 20 of the image forming apparatus A-1. As soon as the retrieval ends, the procedure proceeds to step S28.

At step S28, the use status information retrieved from the image forming apparatus A-1 is integrated by the CPU 19 with the use status information (print dot number, print sheet number, drum rotation number/use time information or the like) of the process cartridge B detected by the print dot counting means 21, the print sheet number counting means (not shown), the drum rotation number/use time counting means (not shown) or the like, and the integrated use status information is rewritten and stored at any time as the use status information peculiar to the process cartridge B in the main body memory 20. Further, whenever necessary, the integrated use status information is indicated using the indicating means 22.

Then, the procedure proceeds to step S29, where it is judged whether the integrated use status information (for example, the integrated print dot number) exceeds the predetermined value or not. If the integrated print dot number does not exceed the predetermined value, the life of the process cartridge B has not yet ended, and thus, the image formation can be continued. On the other hand, if the integrated print dot number exceeds the predetermined value, since the life of the process cartridge B has ended, the indicating means 22 indicates that fact and invites the user to exchange the process cartridge B, and print use past record information such as the total print dot number, the total print sheet number, or the total drum rotation number/use time by the recording means 106 onto a recording sheet of paper (S30).

In a case where the process cartridge B is used in the image forming apparatus A-1 and then is moved to and used in other image forming apparatus, the image forming apparatus A-1, A-2, A-3, . . . described in the present embodiment recognize the identification of the process cartridge B, manage its life, and give and receive its use status information according to a similar procedure.

In this way, each of the image forming apparatus A-1, A-2, A-3, . . . according to the present embodiment can input the use status information with regard to the process cartridge B used in other electrophotographic image forming apparatus based on the individual identifying information (recognition code) of the process cartridge B using the input means 102. This makes it possible for the plurality of electrophotographic image forming apparatus A-1, A-2, A-3, . . . to share the use status information of the identical process cartridge when the process cartridge is used in the plurality of image forming apparatus A-1, A-2, A-3, . . .

Further, since the use past record information of the process cartridge B is printed onto a recording sheet of paper by the recording means 106, the use past record information of the process cartridge B such as the total print dot number, the total print sheet number, or the total drum rotation number/use time is known when the process cartridge B is recycled, and a judgment about reused parts can be made easily. In addition, the use past record information can be fed back to aid in the designing of parts.

As described in the above, when the process cartridge B ends its life, the indicating means 22 indicates that fact and invites the user to exchange the process cartridge B, and the use past record information such as the total print dot number, the total print sheet number, or the total drum rotation number/use time is printed by the recording means 106 onto a recording sheet of paper. After the process cartridge B is changed, the use past record information of the process cartridge B which ended its life becomes unnecessary. Therefore, the user can erase only that particular use past record information, or the number of individual identifying information which can be stored is fixed in advance and, when the main body memory 20 is full, the CPU 19 erases the individual identifying information in the order from the oldest one.

In the present embodiment, the use status information of the process cartridge B is inputted using the input means 102 of the image forming apparatus A-1, A-2, A-3, . . . . However, the use status information of the process cartridge B may be inputted from input means (not shown) of a computer connected to the image forming apparatus A-1, A-2, A-3, . . . , or from a reader (not shown). In a case where input is carried out using the reader, the use status information outputted at step S21 of the present embodiment may be expressed by image information such as a bar code or a graphic in addition to one written in letters, numerals, symbols, or the like such that a user can distinguish them.

(Third Embodiment)

The present embodiment is an example of an electrophotographic image forming apparatus which is constituted to recognize an identification of a process cartridge, manage its life, and give and receive its use status information by adding the input means used in the above described second embodiment to the electrophotographic image forming apparatus of the first embodiment.

(Constitution of Recognizing Identification of Process Cartridge and Constitution of Managing its Life)

The constitution of recognizing an identification of a process cartridge, the constitution of managing its life, and the method of communicating its use status information in the electrophotographic image forming apparatus according to the present embodiment are now described with reference to FIGS. 8, 9A and 9B. It is to be noted that FIG. 8 is an explanatory view of the constitution of recognizing an identification of a process cartridge, the constitution of managing its life, and the constitution of communicating its use status information in the electrophotographic image forming apparatus, and FIGS. 9A and 9B are flowcharts illustrating the procedure in the method of recognizing an identification of a process cartridge, detecting its life, and communicating its use status information.

Figure 8:
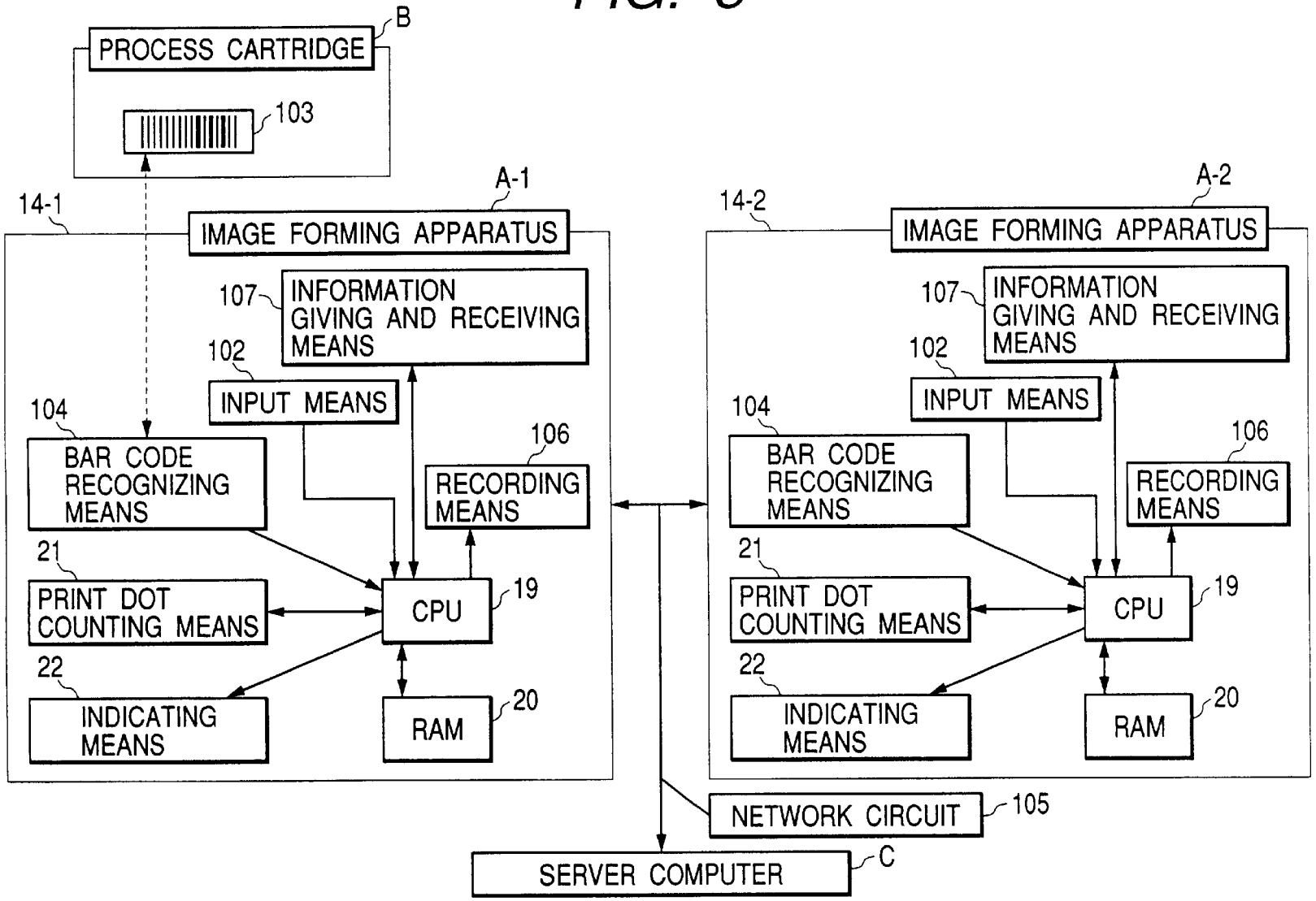
FIG. 8 is an explanatory view of the constitution of recognizing and identifying a process cartridge, the constitution of managing its life, and the constitution of communicating its use status information in an electrophotographic image forming apparatus according to a third embodiment of the present invention.

As shown in FIG. 8, each of the image forming apparatus A-1, A-2, A-3 (not shown), . . . according to the present embodiment has in its image forming apparatus main body 14-1, 14-2, 14-3, . . . the CPU 19 as controlling means, the RAM (hereinafter referred to as "a main body memory") 20 as storing means, the print dot counting means 21 as detecting means, the indicating means 22, the bar code recognizing means 104 as recognizing means, the recording means 106, the information giving and receiving means 107 such as a modem, and the input means 102 for inputting the use status information of the process cartridge B. The image forming apparatus A-1, A-2, A-3, . . . are connected in parallel through a network circuit 105 as correspondence means connected to their respective information giving and receiving means 107. It is to be noted that parts identical with or corresponding to those in the first and second embodiments are designated by identical reference characters and the detailed description thereof is omitted.

Figures 9, 9A:
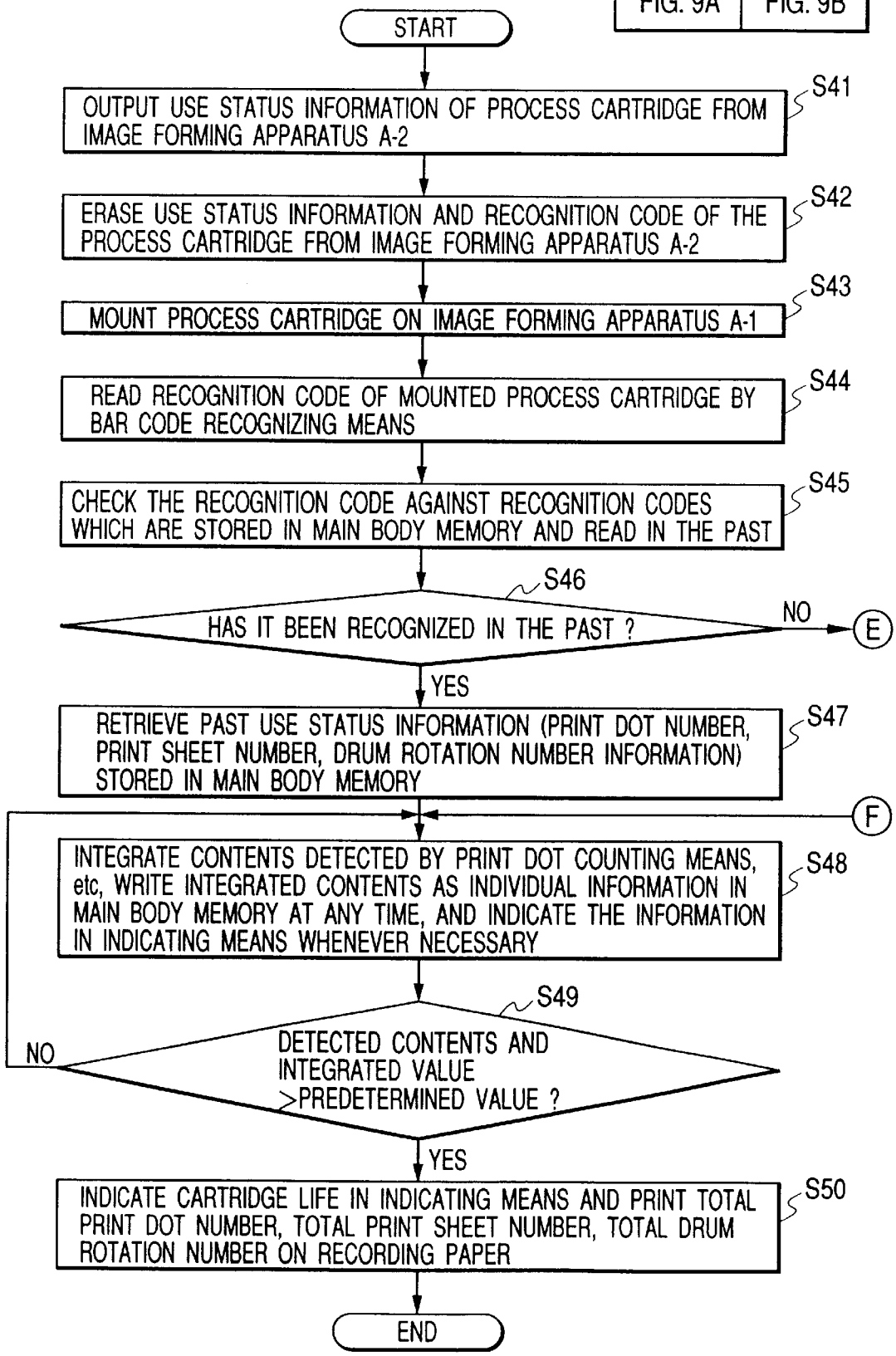
FIG. 9, which is comprised of FIGS. 9A and 9B, is a flowchart illustrating the procedure in the method of recognizing and identifying a process cartridge, detecting its life, and communicating its use status information in the electrophotographic image forming apparatus according to the third embodiment of the present invention.
Figure 9B:
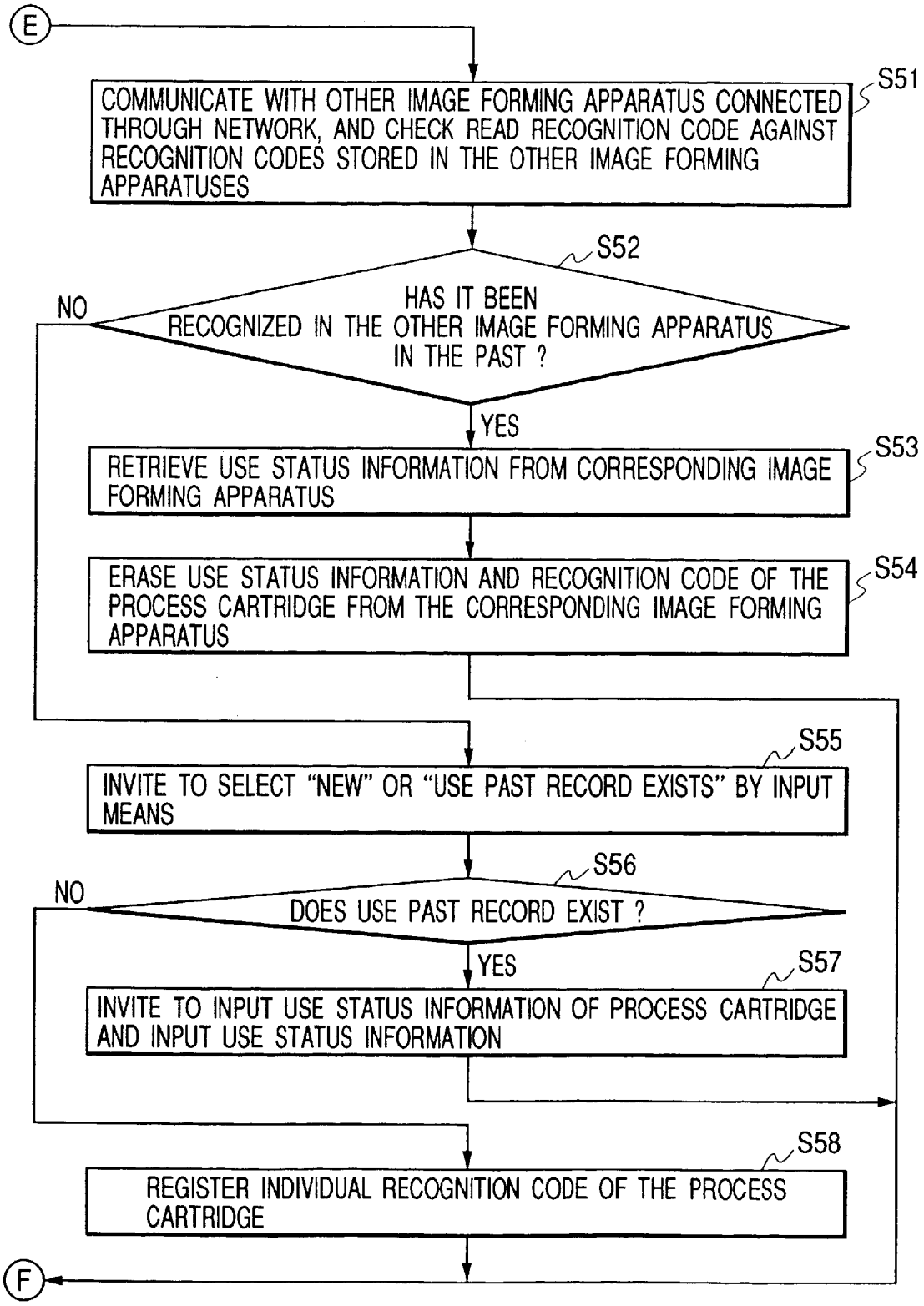

Recognizing an identification of a process cartridge, detecting its life, and communicating its use status information in the electrophotographic image forming apparatus according to the present embodiment is now described according to the procedure illustrated in the flowcharts of FIGS. 9A and 9B.

The present embodiment is described on the assumption that, in FIG. 8, the process cartridge B which has been used in the image forming apparatus A-2 is moved to and used in the image forming apparatus A-1.

With the process cartridge B mounted to the image forming apparatus main body 14-2 of the image forming apparatus A-2, the contents of the use status information (print dot number, print sheet number, drum rotation number/use time information or the like) of the process cartridge B stored in the main body memory 20 of the image forming apparatus A-2 is outputted by printing them onto a recording sheet of paper by the recording means 106 (S41).

After the use status information of the process cartridge B is outputted, the use status information and the recognition code of the process cartridge B are erased (S42).

The use status information is written in letters, numerals, symbols, or the like such that a such that a user can distinguish them.

When the process cartridge B is mounted to the image forming apparatus main body 14-1 of the image forming apparatus A-1 (S43), the recognition code on the bar code 103 provided on the process cartridge B is read by the bar code recognizing means 104 (S44).

Similarly to the case of the second embodiment described in the above, the timing of reading the recognition code may be arbitrary. For example, the recognition code may be read at the time of initial rotation of the photosensitive drum 7, or when the openable and closable member 15 is opened and closed for the purpose of changing the process cartridge.

After the recognition code is read, the CPU 19 checks the recognition code read this time against recognition codes stored in the main body memory 20 and read in the past (S45).

As a result of the check (S46), if the recognition code read this time has been recognized in the past (YES), it is judged that the process cartridge B is remounted, and the procedure proceeds to step S47. If the recognition code read this time has not been recognized (NO), it is judged that the process cartridge B is used for the first time in the image forming apparatus A-1 (a new process cartridge or a process cartridge which has been used in another image forming apparatus A-2), and the procedure proceeds to step S51.

Here, since the process cartridge B is moved from the image forming apparatus A-2 to the image forming apparatus A-1, the procedure proceeds to step S51.

At step S51, the image forming apparatus A-1 communicates with other image forming apparatus A-2, A-3, . . . connected through the network circuit 105 using the network circuit 105, and checks the recognition code read this time against recognition codes stored in the main body memories 20 of other image forming apparatus A-2, A-3, . . .

As a result of the check (S52), if the recognition code has not been recognized by other image forming apparatus A-2, A-3, . . . in the past (NO), the procedure proceeds to step S55. If the recognition code has been recognized (YES), the procedure proceeds to step S53.

If the recognition code has been recognized, at step S53, use status information (print dot number, print sheet number, drum rotation number/use time information or the like) of the process cartridge B is retrieved from the main body memory 20 of the image forming apparatus A-2, A-3, . . . Then, the use status information and the recognition code with regard to the process cartridge B stored in the image forming apparatus A-2, A-3, . . . are erased (S54), and the procedure proceeds to step S48.

At step S48, the use status information (print dot number, print sheet number, drum rotation number/use time information or the like) retrieved from other image forming apparatus A-2, A-3, . . . is integrated by the CPU 19 with the use status information (print dot number, print sheet number, drum rotation number/use time information or the like) of the process cartridge B detected by the print dot counting means 21, the print sheet number counting means (not shown), the drum rotation number/use time counting means (not shown) or the like, and the integrated use status information is rewritten and stored at any time as the use status information peculiar to the process cartridge B in the main body memory 20. Further, whenever necessary, the integrated use status information is indicated using the indicating means 22.

Then, the procedure proceeds to step S49, where it is judged whether the integrated use status information (for example, the integrated print dot number) of the process cartridge B exceeds the predetermined value or not. If the integrated print dot number does not exceed the predetermined value, the life of the process cartridge B has not yet ended, and thus, the image formation can be continued. On the other hand, if the integrated print dot number exceeds the predetermined value, since the life of the process cartridge B has ended, the indicating means 22 indicates that fact and invites the user to exchange the process cartridge B, and use past record information such as the total print dot number, the total print sheet number, or the total drum rotation number/use time is printed by the recording means 106 onto a recording sheet of paper (S50).

If, at step S52, the recognition code has not been recognized by other image forming apparatus A-2, A-3, the user is invited by the indicating means 22 of the image forming apparatus A-1 to select "new" or "use past record exists" using the input means 102 (S55).

As a result of the selection (S56), if "use past record exists" (YES), the procedure proceeds to step S57. If "new" (NO), the procedure proceeds to step S58.

At step S57, the indicating means 22 is used to make an indication to invite the user to input use status information of the process cartridge B using the input means 102. The user inputs the use status information outputted at step S41 to the image forming apparatus A-1.

When the input operation by the user ends, the procedure proceeds to step S48.

At step S48, the use status information of the process cartridge B detected by the print dot counting means 21, the print sheet number counting means (not shown), the drum rotation number/use time counting means (not shown) or the like is integrated by the CPU 19 with the past use status information (print dot number, print sheet number, drum rotation number/use time information or the like) inputted to the image forming apparatus A-1, and the integrated use status information is rewritten and stored at any time as the use status information peculiar to the process cartridge B in the main body memory 20. Further, whenever necessary, the integrated use status information is indicated using the indicating means 22. The timing of rewriting in the main body memory 20 may be set arbitrarily, for example, every time after image recording onto the recording medium 2 ends, or, at the time of post-rotation of the photosensitive drum 7 (a period after the image recording ends during which the photosensitive drum 7 is rotatively driven thereby making the image forming apparatus A-1 carry out a predetermined post-operation for some time).

Then, it is determined whether the integrated use status information (for example, the integrated print dot number) of the process cartridge B exceeds a predetermined value or not (S49). The predetermined value is the value of the print dot number immediately before satisfactory image formation becomes impossible due to toner depletion as a result of using the process cartridge B. The value is written in the main body memory 20.

If the integrated print dot number does not exceed the predetermined value, the life of the process cartridge B has not yet ended, and thus, the image formation can be continued. On the other hand, if the integrated print dot number exceeds the predetermined value, since the life of the process cartridge B has ended, the indicating means 22 indicates that fact and invites the user to exchange the process cartridge B, and use past record information, such as the total print dot number, the total print sheet number, or the total drum rotation number/use time, is printed by the recording means 106 onto a recording sheet of paper (S50).

As a result of the selection at step S56, if "new", the procedure proceeds to step S58.

At step S58, the individual recognition code of the process cartridge B is newly registered in the main body memory 20.

As soon as the registration of the individual recognition code of the process cartridge B ends, the procedure proceeds to step S48.

At step S48, the use status information (print dot number, print sheet number, drum rotation number/use time information or the like) of the process cartridge B detected by the print dot counting means 21, the print sheet number counting means (not shown), the drum rotation number/use time counting means (not shown) or the like is rewritten and stored by the CPU 19 in the main body memory 20 at any time as the use status information peculiar to the process cartridge B. Further, whenever necessary, the integrated use status information is indicated using the indicating means 22.

Then, the procedure proceeds to step S49, where it is judged whether the use status information (contents detected by the print dot counting means 21, the print sheet number counting means (not shown), the drum rotation number/use time counting means (not shown) or the like) exceeds the predetermined value or not. If the integrated print dot number does not exceed the predetermined value, the life of the process cartridge B has not yet ended, and thus, the image formation can be continued. On the other hand, if the integrated print dot number exceeds the predetermined value, since the life of the process cartridge B has ended, the indicating means 22 indicates that fact and invites the user to exchange the process cartridge B, and use past record information such as the total print dot number, the total print sheet number, or the total drum rotation number/use time is printed by the recording means 106 onto a recording sheet of paper (S50).

If, at step S46, the recognition code has been recognized in the past, it is judged that the process cartridge B is remounted, and the procedure proceeds to step S47.

At step S47, use status information (print dot number, print sheet number, drum rotation number/use time information or the like) of the process cartridge B is retrieved from the main body memory 20 of the image forming apparatus A-1. As soon as the retrieval ends, the procedure proceeds to step S48.

At step S48, the use status information retrieved from the image forming apparatus A-1 is integrated by the CPU 19 with the use status information (print dot number, print sheet number, drum rotation number/use time information or the like) of the process cartridge B detected by the print dot counting means 21, the print sheet number counting means (not shown), the drum rotation number/use time counting means (not shown) or the like, and the integrated use status information is rewritten and stored at any time as the use status information peculiar to the process cartridge B in the main body memory 20. Further, whenever necessary, the integrated use status information is indicated using the indicating means 22.

Then, the procedure proceeds to step S49, where it is judged whether the integrated use status information (for example, the integrated print dot number) of the process cartridge B exceeds the predetermined value or not. If the integrated print dot number does not exceed the predetermined value, the life of the process cartridge B has not yet ended, and thus, the image formation can be continued. On the other hand, if the integrated print dot number exceeds the predetermined value, since the life of the process cartridge B has ended, the indicating means 22 indicates that fact and invites the user to exchange the process cartridge B, and use past record information such as the total print dot number, the total print sheet number, or the total drum rotation number/use time is printed by the recording means 106 onto a recording sheet of paper (S50).

In a case where the process cartridge B is used in the image forming apparatus A-2, A-3, . . . other than the image forming apparatus A-1, the image forming apparatus A-1, A-2, A-3, . . . described in the present embodiment recognize the identification of the process cartridge B, manage its life, and communicate its use status information according to a similar procedure.

In this way, each of the image forming apparatus A-1, A-2, A-3, . . . according to the present embodiment can input the use status information with regard to the process cartridge B used in other image forming apparatus based on the individual identifying information (recognition code) of the process cartridge B using the input means 102. Further, each of the image forming apparatus A-1, A-2, A-3, . . . according to the present embodiment can communicate the use status information with regard to the process cartridge B stored in other image forming apparatus with other image forming apparatus based on the individual identifying information (recognition code) of the process cartridge B through the network circuit 105 using the information giving and receiving means 107. In other words, each of the image forming apparatus A-1, A-2, A-3, . . . according to the present embodiment can, using the input means 102, input the use status information of the process cartridge B used in other image forming apparatus, and can communicate the use status information of the process cartridge B inputted using the input means 102 with other image forming apparatus based on the individual identifying information of the process cartridge B through the network circuit 105 using the information giving and receiving means 107. This makes it possible for the plurality of image forming apparatus to share the use status information of the identical process cartridge when the process cartridge is used in the plurality of image forming apparatus.

Further, since the use past record information of the process cartridge B is printed onto a recording sheet of paper by the recording means 106, the use past record information of the process cartridge B such as the total print dot number, the total print sheet number, or the total drum rotation number/use time is known when the process cartridge B is recycled, and judgment of reused parts can be made easily. In addition, the use past record information can be fed back to designing of parts.

As described in the above, when the process cartridge B ends its life, the indicating means 22 indicates that fact and invites the user to exchange the process cartridge B, and the use past record information, such as the total print dot number, the total print sheet number, or the total drum rotation number/use time, is printed by the recording means 106 onto a recording sheet of paper. After the process cartridge B is exchanged, the use past record information of the process cartridge B which ends its life becomes unnecessary. Therefore, the user can erase only that particular use past record information, or the number of individual identifying information which can be stored is fixed in advance, and when the main body memory 20 is full, the CPU 19 erases the individual identifying information in the order from the oldest one.

In the present embodiment, an example where the use status information of the process cartridge B is stored in main body memories 20 provided in the image forming apparatus A-1, A-2, A-3, . . . which use the process cartridge B has been described. However, the use status information of the process cartridge B may be stored in storing means (not shown) of a server computer C connected through the network circuit 105 such that the use status information of each process cartridge is retrieved from the server computer C whenever necessary. Such constitution has an advantage that the use status of a plurality of process cartridges used in a plurality of image forming apparatus can be managed collectively in a centralized way.

Further, in the present embodiment, the use status information of a process cartridge is communicated between a plurality of image forming apparatus through the network circuit 105 connected to the information giving and receiving means 107. However, no problem arises even if the communication is through infrared radiation or electromagnetic wave. Such communication has an advantage that the network circuit 105 can be eliminated.

Still further, in the present embodiment, the plurality of image forming apparatus may be connected in parallel or may be connected serially through the network circuit 105.

In the present embodiment, the use status information of the process cartridge B is inputted using the input means 102 of the image forming apparatus A-1, A-2, A-3, . . . However, the use status information of the process cartridge B may be inputted from input means (not shown) of a computer connected to the image forming apparatus A-1, A-2, A-3, . . . , or from a reader (not shown). In a case where input is carried out using the reader, the use status information outputted at step S21 of the present embodiment may be expressed by image information, such as a bar code or a graphic, in addition to one written in letters, numerals, symbols, or the like such that a user can distinguish them.

As described in the above, electrophotographic image forming apparatus according to the present invention can share use status information of the identical process cartridge when the process cartridge is used in the plurality of image forming apparatus.

Therefore, during use of a process cartridge, useful information such as the usage or the remaining amount of the developer contained therein can be accurately transmitted to the user. Further, after process cartridge ends their life, the individual identifying information of the respective process cartridges can be used in the recycle of the process cartridges, and can be fed back to the designing site.

Namely, the above-described electrophotographic image forming apparatus can communicate the use status information with regard to a process cartridge stored in other electrophotographic image forming apparatus with other image forming apparatus based on the identifying information of the process cartridge using the information communicating means. This makes it possible for the plurality of electrophotograhpic image forming apparatus to share the use status information of the identical process cartridge when the process cartridge is used in the plurality of electrophotographic image forming apparatus.

Further, the above-described electrophotographic image forming apparatus can input the use status information with regard to a process cartridge used in other electrophotographic image forming apparatus based on the identifying information of the process cartridge using the input means. Further, the above-described electrophotographic image forming apparatus can communicate the use status information with regard to a process cartridge stored in other electrophotographic image forming apparatus with other image forming apparatus based on the identifying information using the information communicating means. In other words, the above-described electrophotographic image forming apparatus can, using the input means, input the use status information of the process cartridge used in other image forming apparatus, and can communicate the use status information of the process cartridge inputted using the input means with other image forming apparatus based on the identifying information using the information communicating means. This makes it possible for the plurality of image forming apparatus to share the use status information of the identical process cartridge when the process cartridge is used in the plurality of image forming apparatus.

Still further, the above-described electrophotographic image forming apparatus can input the use status information with regard to a process cartridge used in other electrophotographic image forming apparatus based on the identifying information of the process cartridge using the input means. This makes it possible for the plurality of image forming apparatus to share the use status information of the identical process cartridge when the process cartridge is used in the plurality of image forming apparatus.

(Other Embodiments)

In the first, second, and third embodiments described in the above, the print dot number of the process cartridge B, the print sheet number of the recording medium 2, the drum rotation number of the photosensitive drum 7, and the use time of the photosensitive drum 7 are given as examples of the use status information with regard to the process cartridge B detected by the image forming apparatus A-1 and A-2. However, the use status information further may include:

- the numbers of sheets outputted by size of the recording medium;
- the time during which the process cartridge is mounted;
- the time during which the electrophotographic image forming apparatus is energized with the process cartridge mounted thereto;
- the time during which voltage is applied to the charging roller of the process cartridge;
- the remaining amount of the developer (the remaining amount of the toner) contained in the process cartridge; and
- the amount of use of the developer (the amount of use of the toner) contained in the process cartridge.

Further, in the first, second, and third embodiments described in the above, as an example of the constitution of recognizing the identification of the process cartridge B, one where the bar code 13 is provided on the process cartridge and the bar code recognizing means 104 is provided in the image forming apparatus main body is described. However, the constitution of recognizing the identification of the process cartridge B further includes constitutions where:

- an electric resistance member with the individual identifying information set as a predetermined electric resistance value is used instead of the bar code 13 of the process cartridge, and electric resistance value determining means for determining the electric resistance value of the electric resistance member is used instead of the bar code recognizing means 104 of the image forming apparatus main body; and
- a capacitor with the individual identifying information set as a predetermined capacitance value is used instead of the bar code 13 of the process cartridge, and capacitance value determining means for determining the capacitance value of the capacitor is used instead of the bar code recognizing means 104 of the image forming apparatus main body.

Further, although in the above-described embodiments, the life of the process cartridge B is judged using the print dot number, the life may be managed using use status information described in the following.

By combining the toner remaining amount information obtained from the antenna bar 10*f* as the toner remaining amount detecting means with the print dot number information, the number of recordable sheets of the recording medium 2 can be calculated and indicated.

Further, although in the above-described embodiments, the life of the process cartridge B is managed through grasping the amount of use of the toner, in a large-capacity process cartridge, depending on the image ratio, the life of the photosensitive drum 7 or other sliding parts can be lost before the process cartridge B runs out of toner. In this case, it is more preferable that the rotation number or the integrated rotation time of the photosensitive drum or other sliding parts is also detected from the rotation number of the driving system of the image forming apparatus main body, and the life of the process cartridge B is managed using them jointly.

Though, in the first, second, and third embodiments described in the above, the indicating means 22 is provided in each of the image forming apparatus main bodies 14-1, 14-2, 14-3, . . . , the indicating means may be provided on external apparatus connected to the image forming apparatus (for example, CRTs of personal computers).

Further, although in the above-described embodiments, the process cartridge B is for forming monochrome images, the present invention is not limited thereto, and may also be suitably applied to a cartridge for forming images of a plurality of colors (for example, two-color images, three-color images, full color images, and the like) with a plurality of developing means.

Still further, as the developing method, various kinds of developing methods including the publicly known two-component magnetic brush developing method, cascade developing method, touchdown developing method, and cloud developing method or the like may be used.

Further, the electrophotographic photosensitive member is not limited to the above-described photosensitive drum, and for example the following may also be used. As the photosensitive member, a photoconductor may be used. Such photoconductors include amorphous silicon, amorphous selenium, zinc oxide, titanium oxide, and organic photoconductors (OPCs). The shape of the mounted photosensitive member includes a rotating member in the shape of drum, belt or the like and a sheet-shaped member and the like. It is to be noted that a drum-shaped or a belt-shaped member is generally used, and, for example in a drum-shaped photosensitive member, a photoconductor is vapor deposited or applied on a cylinder of an aluminum alloy or the like.

Further, although in the above-described embodiments, the charging means is constituted using the so-called contact charging method, the constitution may also be one where a metal shield of aluminum or the like is provided around three sides of conventionally used tungsten wire and positive or negative ions generated by applying high voltage to the tungsten wire is moved to the surface of the photosensitive drum to uniformly charge the surface of the drum.

It is to be noted that the charging means is not limited to the above-described roller type, and a blade type (a charging blade), a pad type, a block type, a rod type, a wire type, or the like may also be used.

It is further to be noted that the cleaning method of the toner remaining on the photosensitive drum is not limited to the above-described cleaning blade, and the cleaning means may be constituted using a fur brush, a magnetic brush, or the like.

As the material for forming the toner frame 12*a* and the developing frame 12*b*, plastic such as polystyrene, ABS resin (acrylonitrile butadiene styrene copolymer), modified PPE resin (polyphenylene ethyl), modified PPO resin (polyphenylene oxide), polycarbonate, polyethylene, and polypropylene may be used.

Further, the above-described process cartridge is, for example, provided with an electrophotographic photosensitive member and at least one process means. Therefore, the process cartridge may be, for example, other than the one described in the above, such as one where an electrophotographic photosensitive member and charging means are made integrally into a cartridge which is detachably mountable to an image forming apparatus main body, one where an electrophotographic photosensitive member and developing means are made integrally into a cartridge which is detachably mountable to an image forming apparatus main body, one where an electrophotographic photosensitive member and cleaning means are made integrally into a cartridge which is detachably mountable to an image forming apparatus main body, or one where an electrophotographic photosensitive member and two or more of the above-described process means are made integrally into a cartridge which is detachably mountable to an image forming apparatus main body.

Namely, the above-described process cartridge makes the charging means, the developing means, or the cleaning means and the electrophotographic photosensitive member integrally into a cartridge which is detachably mountable to the image forming apparatus main body. Or, the process cartridge makes at least one of the charging means, the developing means, and the cleaning means and the electrophotographic photosensitive member integrally into a cartridge which is detachably mountable to the image forming apparatus main body. Alternatively, the process cartridge makes at least the developing means and the electrophotographic photosensitive member integrally into a cartridge which is detachably mountable to the image forming apparatus main body. The process cartridge can be detachably mounted to the apparatus main body by a user himself. Therefore, maintenance of the apparatus main body can be handled by the user himself.

Further, though in the above-described embodiments, a laser beam printer is described as an example of the image forming apparatus, the present invention is not limited thereto, and is of course applicable to other image forming apparatus such as an electrophotographic copying machine, a facsimile machine, and a word processor.

As described in the above, an electrophotographic image forming apparatus according to the present invention can share the use status information of the identical process cartridge when the process cartridge is used in a plurality of image forming apparatus.

While the invention has been described with reference to the structures disclosed herein, it is not confined to the details set forth and this application is intended to cover such modifications or changes as may come within the purposes of the improvements or the scope of the following claims.

What is claimed is:

1. An electrophotographic image forming apparatus to which a process cartridge is detachably mountable for forming an image onto a recording medium, said image forming apparatus comprising:

recognizing means for recognizing identifying information peculiar to the process cartridge;

detecting means for detecting use status information when the process cartridge is used in said image forming apparatus;

rewritable storing means for storing said identifying information recognized by said recognizing means and the use status information of the process cartridge detected by said detecting means; and information communicating means for giving and receiving the use status information of the process cartridge stored in another electrophotographic image forming apparatus to which the process cartridge is detachably mountable to and from the another electrophotographic image forming apparatus.

2. An electrophotographic image forming apparatus to which a process cartridge is detachably mountable for forming an image onto a recording medium, said image forming apparatus comprising:

recognizing means for recognizing identifying information peculiar to the process cartridge;

detecting means for detecting use status information when the process cartridge is used in said image forming apparatus;

input means for inputting use status information when the process cartridge is used in another electrophotographic image forming apparatus to which the process cartridge is detachably mountable;

rewritable storing means for storing the identifying information of the process cartridge recognized by said recognizing means and the use status information of the process cartridge detected by said detecting means or the use status information of the process cartridge inputted by said input means; and information communicating means for giving and receiving the use status information of the process cartridge stored in the another electrophotographic image forming apparatus to and from the another electrophotographic image forming apparatus.

3. An electrophotographic image forming apparatus as claimed in claim 1 or 2, wherein the use status information of the process cartridge is communicated by the information communicating means through correspondence means connecting said image forming apparatus and the another image forming apparatus.

4. An electrophotographic image forming apparatus as claimed in claim 3, wherein the correspondence means is a network circuit to which said image forming apparatus and the another image forming apparatus are connected.

5. An electrophotographic image forming apparatus as claimed in claim 3, wherein the correspondence means uses infrared radiation as a medium.

6. An electrophotographic image forming apparatus as claimed in claim 3, wherein the correspondence means uses electromagnetic waves as a medium.

7. An electrophotographic image forming apparatus as claimed in claim 1 or 2, wherein the use status information of the process cartridge is communicated by said information communicating means between said image forming apparatus and the another image forming apparatus.

8. An electrophotographic image forming apparatus as claimed in claim 1 or 2, wherein the use status information of the process cartridge is communicated by said information communicating means through a server computer connected to a network circuit as correspondence means to which said image forming apparatus and the another image forming apparatus are connected.

9. An electrophotographic image forming apparatus as claimed in claim 3, wherein the correspondence means connects in parallel to said image forming apparatus and the another image forming apparatus.

10. An electrophotographic image forming apparatus as claimed in claim 3, wherein the correspondence means serially connects said image forming apparatus and the another image forming apparatus.

11. An electrophotographic image forming apparatus to which a process cartridge is detachably mountable for forming an image onto a recording medium, said image forming apparatus comprising:

recognizing means for recognizing identifying information peculiar to the process cartridge;

detecting means for detecting use status information when the process cartridge is used in said image forming apparatus;

input means for inputting use status information when the process cartridge is used in another electrophotographic image forming apparatus to which the process cartridge is detachably mountable; and rewritable storing means for storing the identifying information recognized by said recognizing means and the use status information detected by said detecting means or the use status information inputted by said input means.

12. An electrophotographic image forming apparatus as claimed in claim 2 or 11, wherein the use status information of the process cartridge is inputted to said input means from a computer connected to said image forming apparatus.

13. An electrophotographic image forming apparatus as claimed in claim 2 or 11, wherein the use status information of the process cartridge is inputted to said input means from a reader connected to said image forming apparatus.

14. An electrophotographic image forming apparatus as claimed in any one of claims 1, 2, or 11 wherein the identifying information of the process cartridge is represented by a bar code and said recognizing means of said image forming apparatus is bar code recognizing means for recognizing the bar code.

15. An electrophotographic image forming apparatus as claimed in any one of claims 1, 2, or 11 wherein the identifying information of the process cartridge is set as a predetermined electric resistance value of an electric resistance member and said recognizing means of said image forming apparatus is electric resistance value determining means for determining the electric resistance value of the electric resistance member.

16. An electrophotographic image forming apparatus as claimed in any one of claims 1, 2, or 11 wherein the identifying information of the process cartridge is set as a predetermined capacitance value of a capacitor and said recognizing means of said image forming apparatus is capacitance value determining means for determining the capacitance value of the capacitor.

17. An electrophotographic image forming apparatus as claimed in any one of claims 1, 2, or 11 wherein the use status information detected by said detecting means is a rotation number of an electrophotographic photosensitive member of the process cartridge.

18. An electrophotographic image forming apparatus as claimed in any one of claims 1, 2, or 11 wherein the use status information detected by said detecting means is said rotation time of an electrophotographic photosensitive member of the process cartridge.

19. An electrophotographic image forming apparatus as claimed in any one of claims 1, 2, or 11 wherein the use status information detected by said detecting means is a print dot number of the process cartridge.

20. An electrophotographic image forming apparatus as claimed in any one of claims 1, 2, or 11 wherein the use status information detected by said detecting means is an output sheet number of the recording medium.

21. An electrophotographic image forming apparatus as claimed in any one of claims 1, 2, or 11 wherein the use status information detected by said detecting means represents the number of sheets outputted by size of the recording medium.

22. An electrophotographic image forming apparatus as claimed in any one of claims 1, 2, or 11 wherein the use status information detected by said detecting means represents the time during which the process cartridge is mounted to said image forming apparatus.

23. An electrophotographic image forming apparatus as claimed in any one of claims 1, 2, or 11 wherein the use status information detected by said detecting means represents the time during which said image forming apparatus is energized with the process cartridge mounted thereto.

24. An electrophotographic image forming apparatus as claimed in any one of claims 1, 2, or 11 wherein the use status information detected by said detecting means represents the time during which voltage is applied to charging means of the process cartridge.

25. An electrophotographic image forming apparatus as claimed in any one of claims 1, 2, or 11 wherein the use status information detected by said detecting means represents the remaining amount of developer contained in the process cartridge.

26. An electrophotographic image forming apparatus as claimed in any one of claims 1, 2, or 11 wherein the use status information detected by said detecting means represents the amount of use of developer contained in the process cartridge.

27. An electrophotographic image forming apparatus as claimed in any one of claims 1, 2, or 11 wherein the process cartridge makes an electrophotographic photosensitive member and process means acting on the electrophotographic photosensitive member integrally into a cartridge which is detachably mountable to a main body of said image forming apparatus.

28. An electrophotographic image forming apparatus as claimed in claim 27, wherein the process cartridge makes at least one of charging means for charging the electrophotographic photosensitive member, developing means for developing an electrostatic latent image formed on the electrophotographic photosensitive member, and cleaning means for removing developer remaining on the electrophotographic photosensitive member as the process means, and the electrophotographic photosensitive member integrally into the cartridge.

* * * * *

UNITED STATES PATENT AND TRADEMARK OFFICE

CERTIFICATE OF CORRECTION

PATENT NO. : 6,363,226 B1
DATED : March 26, 2002
INVENTOR(S) : Yoshiyuki Batori

It is certified that error appears in the above-identified patent and that said Letters Patent is hereby corrected as shown below:

Column 4,
Line 60, “a” should read -- an --.

Column 8,
Line 4, “(SB)” should read -- (S8) --.

Column 10,
Line 64, “its” should read -- Its --.

Column 14,
Line 62, “its” should read -- Its --.

Column 15,
Line 49, “such that a” (2nd occurrence) should be deleted.

Signed and Sealed this

Fourth Day of March, 2003

JAMES E. ROGAN
*Director of the United States Patent and Trademark Office*